US012077894B2

(12) United States Patent
Adkins et al.

(10) Patent No.: US 12,077,894 B2
(45) Date of Patent: Sep. 3, 2024

(54) HARDWARE DETECTION AND CYCLE BEHAVIOR MODIFICATION IN LAUNDRY APPLIANCE APPLICATIONS

(71) Applicant: WHIRLPOOL CORPORATION, Benton Harbor, MI (US)

(72) Inventors: Andrew Adkins, Saint Joseph, MI (US); Gregory R. Fulmer, Saint Joseph, MI (US); Eric W. Merrow, Benton Harbor, MI (US); Thomas D. Spicer, Saint Joseph, MI (US)

(73) Assignee: WHIRLPOOL CORPORATION, Benton Harbor, MI (US)

( * ) Notice: Subject to any disclaimer, the term of this patent is extended or adjusted under 35 U.S.C. 154(b) by 165 days.

(21) Appl. No.: 17/165,552

(22) Filed: Feb. 2, 2021

(65) Prior Publication Data

US 2022/0243379 A1 Aug. 4, 2022

(51) Int. Cl.

| | |
|---|---|
| ***D06F 34/20*** | (2020.01) |
| ***D06F 33/44*** | (2020.01) |
| ***D06F 37/40*** | (2006.01) |
| ***D06F 103/04*** | (2020.01) |
| ***D06F 103/18*** | (2020.01) |
| ***D06F 105/46*** | (2020.01) |
| ***D06F 105/56*** | (2020.01) |

(52) U.S. Cl.

CPC ..... *D06F 34/20* (2020.02); *D06F 33/44* (2020.02); *D06F 37/40* (2013.01); *D06F 2103/04* (2020.02); *D06F 2103/18* (2020.02); *D06F 2105/46* (2020.02); *D06F 2105/56* (2020.02)

(58) Field of Classification Search

CPC .. D06F 2013/26; D06F 34/16; D06F 2103/26; D06F 34/20

See application file for complete search history.

(56) References Cited

U.S. PATENT DOCUMENTS

| | | | | |
|---|---|---|---|---|
| 4,494,390 | A * | 1/1985 | Hayashi | D06F 23/04 68/133 |
| 4,858,450 | A * | 8/1989 | Noh | D06F 13/02 68/134 |
| 5,561,990 | A * | 10/1996 | Berkcan | D06F 34/16 73/779 |
| 7,089,800 | B2 | 8/2006 | Kakutani et al. | |
| 7,299,515 | B2 | 11/2007 | Oh et al. | |
| 7,904,985 | B2 | 3/2011 | Hendrickson et al. | |

(Continued)

FOREIGN PATENT DOCUMENTS

| | | |
|---|---|---|
| CN | 203530690 U | 4/2014 |
| DE | 4224934 A1 | 2/1994 |

(Continued)

*Primary Examiner* — Spencer E. Bell

(74) *Attorney, Agent, or Firm* — Brooks Kushman P.C.

(57) ABSTRACT

Hardware detection in a laundry treatment appliance is provided. Data is received from the sensor providing data in relation to presence or absence of a removable agitator within the laundry treatment appliance. A configuration of the removable agitator with respect to the laundry treatment appliance is identified based on the data from the sensor, the configuration indicating at least the presence or absence of the removable agitator. Settings of the laundry treatment appliance are updated in accordance with the identified configuration of the laundry treatment appliance.

16 Claims, 13 Drawing Sheets

(56) References Cited

U.S. PATENT DOCUMENTS

| | | | | |
|---|---|---|---|---|
| 8,528,229 | B2 | 9/2013 | Ashrafzadeh et al. | |
| 9,611,581 | B2 | 4/2017 | Seo et al. | |
| 9,777,419 | B2 | 10/2017 | Bergamo | |
| 10,533,273 | B2 | 1/2020 | Pazzin Curiel et al. | |
| 2007/0299545 | A1 | 12/2007 | Agrawal et al. | |
| 2009/0241270 | A1 | 10/2009 | La Belle et al. | |
| 2015/0067971 | A1* | 3/2015 | Plata Amarillas .... | D06F 39/088 8/137 |
| 2015/0176166 | A1 | 6/2015 | Alexander et al. | |
| 2016/0018318 | A1* | 1/2016 | Borges ..... | G01J 3/46 356/369 |
| 2016/0201243 | A1* | 7/2016 | Bergamo ..... | D06F 37/12 68/4 |
| 2017/0089761 | A1 | 3/2017 | McQuilkin et al. | |
| 2018/0080164 | A1* | 3/2018 | Hoppe ..... | D06F 35/006 |
| 2018/0094375 | A1 | 4/2018 | Ramasco et al. | |
| 2019/0017208 | A1 | 1/2019 | Marangoni et al. | |
| 2019/0062978 | A1 | 2/2019 | Czarnecki et al. | |
| 2019/0264365 | A1 | 8/2019 | Bergamo | |
| 2020/0182988 | A1* | 6/2020 | Pau ..... | G01B 11/026 |
| 2020/0359174 | A1* | 11/2020 | Kessler ..... | H04W 4/029 |
| 2022/0145527 | A1* | 5/2022 | Chong ..... | D06F 75/36 |
| 2022/0195652 | A1* | 6/2022 | Hombroek ..... | D06F 34/18 |

FOREIGN PATENT DOCUMENTS

| | | | |
|---|---|---|---|
| DE | 102013215218 | A1 | 2/2015 |
| EP | 2379790 | B1 | 9/2012 |
| JP | H596082 | A | 4/1993 |
| JP | H6335588 | A | 12/1994 |
| JP | H994376 | A | 4/1997 |
| KR | 1020190037923 | A | 4/2019 |
| WO | 2019132602 | A1 | 7/2019 |

* cited by examiner

HARDWARE DETECTION AND CYCLE BEHAVIOR MODIFICATION IN LAUNDRY APPLIANCE APPLICATIONS

TECHNICAL FIELD

Aspects of the disclosure generally relate to hardware detection and cycle behavior modification in laundry appliance applications.

BACKGROUND

Laundry treating appliances, such as clothes washers, clothes dryers, washing machines, refreshers, and non-aqueous systems, can have a configuration based on a container, such as a laundry basket or drum that defines a drum opening, which may or may not rotate, and that at least partially defines a treating chamber in which laundry items are placed for treating. The laundry treating appliance can have a controller that implements a number of user-selectable, pre-programmed cycles of operation having one or more operating parameters. Hot water, cold water, or a mixture thereof, along with various treating chemistries, or detergents, can be supplied to the treating chamber in accordance with the cycle of operation.

Laundry treating appliances typically operate to treat laundry items by placing the laundry items in contact with treating fluid such as a detergent/water mixture, sometimes referred to as wash liquor, and providing relative motion between the laundry items and the fluid. The controller can further control a motor to rotate the laundry basket or drum according to one of the pre-programmed cycles of operation. The controller can also control a clothes mover provided within the laundry basket or drum and configured to impart mechanical energy to laundry items within the treating chamber according to a selected cycle of operation. The clothes mover can include multiple components, such as a base, which can be provided as an impeller plate, and a barrel, which can be provided as an agitator post, and which can couple to the base.

SUMMARY

In one or more illustrative examples, a system for hardware detection in a laundry treatment appliance is provided. A sensor is configured to provide data in relation to presence or absence of a removable agitator within the laundry treatment appliance. A processor is in communication with the sensor. The processor is programmed to receive data from the sensor, identify a configuration of the removable agitator with respect to the laundry treatment appliance based on the data from the sensor, the configuration indicating at least the presence or absence of the removable agitator, and update settings of the laundry treatment appliance in accordance with the identified configuration of the laundry treatment appliance.

In one or more illustrative examples, a method for hardware detection in a laundry treatment appliance is provided. Data is received from the sensor providing data in relation to presence or absence of a removable agitator within the laundry treatment appliance. A configuration of the removable agitator with respect to the laundry treatment appliance is identified based on the data from the sensor, the configuration indicating at least the presence or absence of the removable agitator. Settings of the laundry treatment appliance are updated in accordance with the identified configuration of the laundry treatment appliance.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
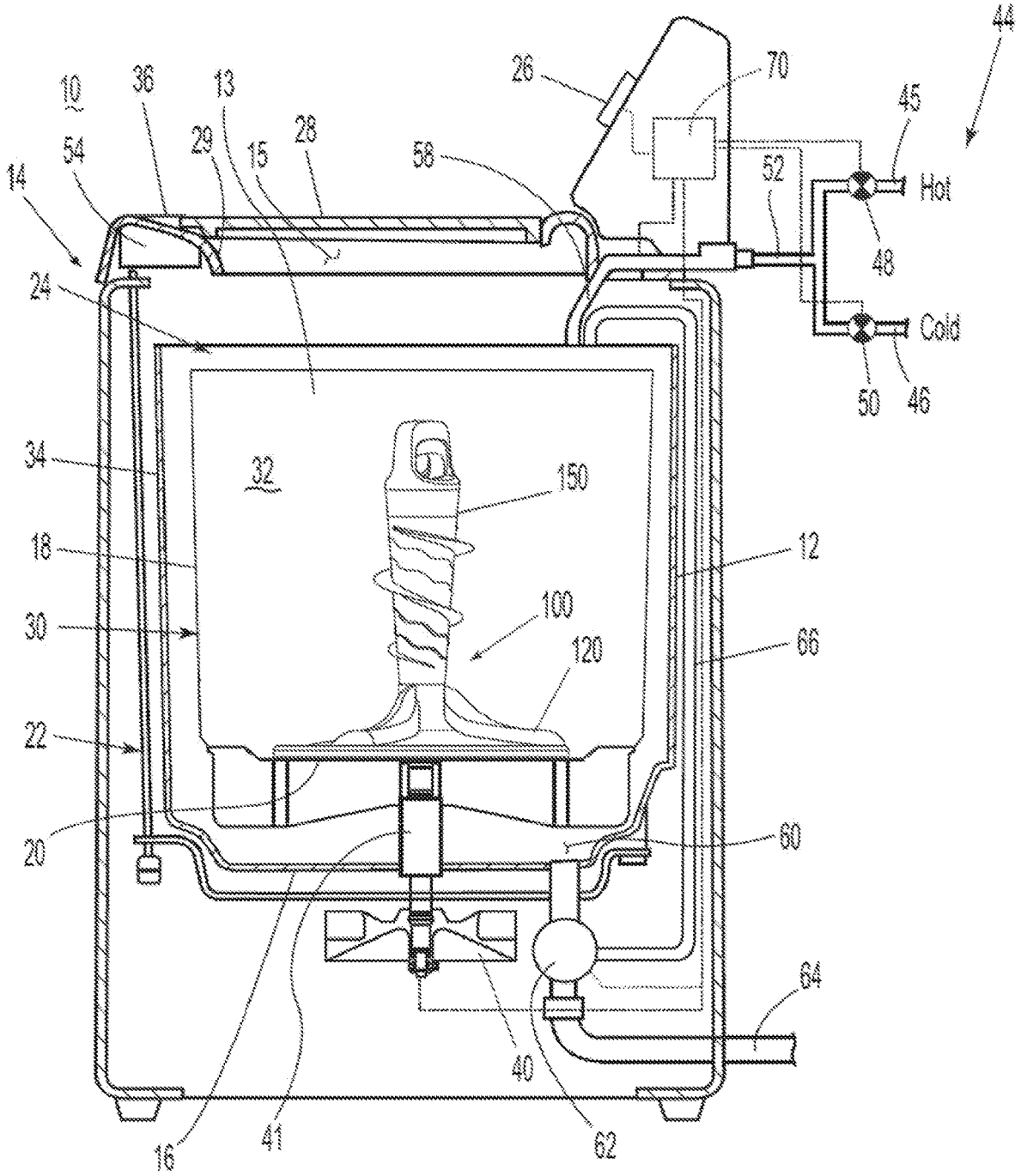
FIG. 1 illustrates a cutaway view of a laundry treating appliance according to aspects of the present disclosure.

FIG. 1 illustrates a cutaway view of a laundry treating appliance 10 according to aspects of the present disclosure. The laundry treating appliance 10 can be any laundry treating appliance 10 that performs a cycle of operation to clean or otherwise treat laundry items placed therein, non-limiting examples of which include a horizontal or vertical axis clothes washer; a clothes dryer; a combination washing machine and dryer; a dispensing dryer; a tumbling or stationary refreshing/revitalizing machine; an extractor; a non-aqueous washing apparatus; and a revitalizing machine. While the laundry treating appliance 10 is illustrated herein as a vertical axis, top-load laundry treating appliance 10, the aspects of the present disclosure can have applicability in laundry treating appliances with other configurations. The laundry treating appliance 10 shares many features of a conventional automated clothes washer and/or dryer, which will not be described in detail herein except as necessary for a complete understanding of the exemplary aspects in accordance with the present disclosure.

Laundry treating appliances are typically categorized as either a vertical axis laundry treating appliance or a horizontal axis laundry treating appliance. As used herein, the term "horizontal axis" laundry treating appliance refers to a laundry treating appliance having a rotatable drum that rotates about a generally horizontal axis relative to a surface that supports the laundry treating appliance. The drum can rotate about the axis inclined relative to the horizontal axis, with fifteen degrees of inclination being one example of the inclination. Similar to the horizontal axis laundry treating appliance, the term "vertical axis" laundry treating appliance refers to a laundry treating appliance having a rotatable drum that rotates about a generally vertical axis relative to a surface that supports the laundry treating appliance. However, the rotational axis need not be perfectly vertical to the surface. The drum can rotate about an axis inclined relative to the vertical axis, with fifteen degrees of inclination being one example of the inclination.

In another aspect, the terms vertical axis and horizontal axis are often used as shorthand terms for the manner in which the appliance imparts mechanical energy to the laundry, even when the relevant rotational axis is not absolutely vertical or horizontal. As used herein, the "vertical axis" laundry treating appliance refers to a laundry treating appliance having a rotatable drum, perforate or imperforate, that holds fabric items and, optionally, a clothes mover, such as an agitator, impeller, nutator, and the like within the drum. The clothes mover can move within the drum to impart mechanical energy directly to the clothes or indirectly through wash liquid in the drum. The clothes mover can typically be moved in a reciprocating rotational movement. In some vertical axis laundry treating appliances, the drum rotates about a vertical axis generally perpendicular to a surface that supports the laundry treating appliance. However, the rotational axis need not be vertical. The drum can rotate about an axis inclined relative to the vertical axis.

As used herein, the "horizontal axis" laundry treating appliance refers to a laundry treating appliance having a rotatable drum, perforated or imperforate, that holds laundry items and washes and/or dries the laundry items. In some horizontal axis laundry treating appliances, the drum rotates about a horizontal axis generally parallel to a surface that supports the laundry treating appliance. However, the rotational axis need not be horizontal. The drum can rotate about an axis inclined or declined relative to the horizontal axis. In horizontal axis laundry treating appliances, the clothes are lifted by the rotating drum and then fall in response to gravity to form a tumbling action. Mechanical energy is imparted to the clothes by the tumbling action formed by the repeated lifting and dropping of the clothes. Vertical axis and horizontal axis machines are best differentiated by the manner in which they impart mechanical energy to the fabric articles.

Regardless of the axis of rotation, a laundry treating appliance can be top-loading or front-loading. In a top-loading laundry treating appliance, laundry items are placed into the drum through an access opening in the top of a cabinet, while in a front-loading laundry treating appliance laundry items are placed into the drum through an access opening in the front of a cabinet. If a laundry treating appliance is a top-loading horizontal axis laundry treating appliance or a front-loading vertical axis laundry treating appliance, an additional access opening is located on the drum.

In more detail, the laundry treating appliance 10 can include a structural support assembly comprising a cabinet 14, which defines a housing and an interior, within which a laundry holding assembly resides. The cabinet 14 can be a housing having a chassis and/or a frame, to which decorative panels can or cannot be mounted, defining an interior, enclosing components typically found in a conventional laundry treating appliance, such as an automated clothes washer or dryer, which can include motors, pumps, fluid lines, controls, sensors, transducers, and the like. Such components will not be described further herein except as necessary for a complete understanding of the present disclosure.

The laundry holding assembly of the illustrated exemplary laundry treating appliance 10 can include a rotatable basket 30 having an open top 13 that can be disposed within the interior of the cabinet 14 and can at least partially define a rotatable treating chamber 32 for receiving laundry items for treatment and an access opening 15. The access opening 15 can provide access to the treating chamber 32. The treating chamber 32 is configured to receive a laundry load comprising laundry items for treatment, including, but not limited to, a hat, a scarf, a glove, a sweater, a blouse, a shirt, a pair of shorts, a dress, a sock, and a pair of pants, a shoe, an undergarment, and a jacket.

The open top 13 can be aligned with the access opening 15. A tub 34 can also be positioned within the cabinet 14 and can define an interior 24 within which the basket 30 can be positioned. The tub 34 can also at least partially define at least a portion of the treating chamber 32. The tub 34 can have a generally cylindrical side or tub peripheral wall 12 closed at its bottom end by a base 16 that can at least partially define a sump 60. The tub 34 can be at least partially aligned with the access opening 15 and the open top 13. In one example, the tub 34, the basket 30, along with the open top 13, and the access opening 15, can have central axes that are co-axial with one another, or with at least one of the other axes, such that a common central axis is formed.

The basket 30 can have a generally peripheral basket side wall 18, which is illustrated as a cylindrical side wall, closed at the basket end by a basket base 20 to further at least partially define the treating chamber 32. The basket 30 can be rotatably mounted within the tub 34 for rotation about a vertical basket axis of rotation and can include a plurality of perforations (not shown), such that liquid can flow between the tub 34 and the rotatable basket 30 through the perforations (not shown). While the illustrated laundry treating appliance 10 includes both the tub 34 and the basket 30, with the basket 30 at least partially defining the treating chamber 32, it is also within the scope of the present disclosure for the laundry holding assembly to include only one receptacle, such as the tub 34, without the basket 30, with the receptacle defining the laundry treating chamber 32 for receiving the load to be treated.

The cabinet 14 can further define a top wall or top panel 36, which can comprise a shroud 29 or to which the shroud 29 can be coupled. The shroud 29 can define at least a portion of the access opening 15, such that the shroud 29 can at least partially encircle the access opening 15. The shroud 29 can curve downwards toward the treating chamber 32 to direct laundry items into the basket 30. The shroud 29 can overlie a portion of the basket 30 such that the laundry items do not fall between the basket 30 and the tub 34.

A selectively openable closure or cover, illustrated herein as comprising a lid 28, can be movably mounted to or coupled to the cabinet 14 for selective movement between an opened position and a closed position, as shown, to selectively open and close the access opening 15, respectively, and to selectively provide access into the laundry treating chamber 32 through the access opening 15 of the basket 30. In one example, the lid 28 can be rotatable between the closed position and the opened position relative to the cabinet 14. By way of non-limiting example, the lid 28 can be hingedly coupled to the cabinet 14 for movement between the opened position and the closed position. In the closed position, the lid 28 can seal against at least one of the access opening 15, the top panel 36, or the shroud 29 and can at least partially confront the treating chamber 32 when the lid 28 closes the access opening 15. In the opened position, the lid 28 can be spaced apart from the access opening 15, the top panel 36, or the shroud 29 and can allow access to the top panel 36 and the access opening 15.

A clothes mover 100 can be rotatably mounted within the basket 30 to impart mechanical agitation and energy to a load of laundry items placed in the basket 30 or the treating chamber 32 according to a cycle of operation. The clothes mover 100 can be oscillated or rotated about its vertical axis of rotation during a cycle of operation in order to produce load motion effective to wash the load contained within the treating chamber 32. The clothes mover 100 can comprise a base or a first clothes mover, illustrated herein as an impeller 120, and a barrel, illustrated herein as an agitator 150. The agitator 150 as illustrated herein can comprise a vertically oriented agitator post that can be removably coupled with the impeller 120, the agitator 150 projecting vertically from the impeller 120 within the treating chamber 32 and toward the open top 13 of the basket 30. In this aspect of the disclosure, the clothes mover 100 can be formed by coupling an additional component, the agitator 150, to the impeller 120 and can be thought of as forming a second clothes mover.

The agitator 150 can include various configurations of vanes, blades, or other structural features for imparting mechanical energy to laundry items during a cycle of operation. In one example, the agitator 150 can be in the form of an auger. Generally, the vertical extent of the agitator 150, combined with vane, blade, or other structural features, can impart the mechanical action to laundry items, which provides improved cleaning performance and can be suitable for particularly soiled loads. Other exemplary types of clothes movers include, but are not limited to, an agitator alone, a wobble plate, and a hybrid impeller/agitator.

The basket 30 and the clothes mover 100 can be driven, such as to rotate within the tub 34, by a drive assembly 40 that includes a motor 41, which can include a gear case, operably coupled with the basket 30 and clothes mover 100. The motor 41 can be a brushless permanent magnet (BPM) motor having a stator (not shown) and a rotor (not shown). Alternately, the motor 41 can be coupled to the basket 30 through a belt and a drive shaft to rotate the basket 30, as is known in the art. Other motors, such as an induction motor or a permanent split capacitor (PSC) motor, can also be used. The motor 41 can rotate the basket 30 at various speeds in either rotational direction about the vertical axis of rotation during a cycle of operation, including at a spin speed wherein a centrifugal force at the inner surface of the basket side wall 18 is 1 g or greater. Spin speeds are commonly known for use in extracting liquid from the laundry items in the basket 30, such as after a wash or rinse step in a treating cycle of operation. A loss motion device or clutch (not shown) can be included in the drive assembly 40 and can selectively operably couple the motor 41 with either the basket 30 and/or the clothes mover 100.

A suspension assembly 22 can dynamically hold the tub 34 within the cabinet 14. The suspension assembly 22 can dissipate a determined degree of vibratory energy generated by the rotation of the basket 30 and/or the clothes mover 100 during a treating cycle of operation. Together, the tub 34, the basket 30, and any contents of the basket 30, such as liquid and laundry items, define a suspended mass for the suspension assembly 22.

The laundry treating appliance 10 can further include a liquid supply assembly to provide liquid, such as water or a combination of water and one or more wash aids, such as detergent, into the treating chamber 32 for use in treating laundry items during a cycle of operation. The liquid supply assembly can include a water supply 44 configured to supply hot or cold water. The water supply 44 can include a hot water inlet 45 and a cold water inlet 46. A valve assembly can include a hot water valve 48, a cold water valve 50, and various recirculation conduits 52, 66 for selectively distributing the water supply 44 from the hot water and cold water inlets 45, 46. The valves 48, 50 are selectively openable to provide water from a source of water, such as from a household water supply (not shown) to the conduit 52. A second water conduit, illustrated as the water inlet 58, can also be fluidly coupled with the conduit 52 such that water can be supplied directly to the treating chamber 32 through the open top of the basket 30. The water inlet 58 can be configured to dispense water, and optionally treating chemistry, into the tub 34 in a desired pattern and under a desired amount of pressure. For example, the water inlet 58 can be configured to dispense a flow or stream of treating chemistry or water into the tub 34 by gravity, i.e., a non-pressurized stream. The valves 48, 50 can be opened individually or together to provide a mix of hot and cold water at a selected temperature. While the valves 48, 50 and conduit 52 are illustrated exteriorly of the cabinet 14, it will be understood that these components can be internal to the cabinet 14.

A treating chemistry dispenser 54 can be provided for dispensing treating chemistry to the basket 30 for use in treating the laundry items according to a cycle of operation, either directly or mixed with water from the water supply 44. The treating chemistry dispenser 54 can be a single use dispenser, a bulk dispenser, or a combination of or an integrated single use and bulk dispenser, in non-limiting examples, and is fluidly coupled to the treating chamber 32. While the treating chemistry dispenser 54 is illustrated herein as being provided at the top panel 36 or the shroud 29, it will be understood that other locations for the treating chemistry dispenser 54 can be contemplated, such as at a different location within the cabinet 14. Further, the treating chemistry dispenser 54 can be provided in a drawer configuration or as at least one reservoir fluidly coupled to the treating chamber 32.

The treating chemistry dispenser 54 can include means for supplying or mixing detergent to or with water from the water supply 44. Alternatively, water from the water supply 44 can also be supplied to the tub 34 through the treating chemistry dispenser 54 without the addition of a detergent. The treating chemistry dispenser 54 can be configured to dispense the treating chemistry or water into the tub 34 in a desired pattern and under a desired amount of pressure. For example, the treating chemistry dispenser 54 can be configured to dispense a flow or stream of treating chemistry or water into the tub 34 by gravity, i.e., a non-pressurized stream.

The treating chemistry dispenser 54 can include multiple chambers or reservoirs fluidly coupled to the treating chamber 32 for receiving doses of different treating chemistries. The treating chemistry dispenser 54 can be implemented as a dispensing drawer that is slidably received within the cabinet 14, or within a separate dispenser housing which can be provided in the cabinet 14. The treating chemistry dispenser 54 can be moveable between a fill position, where the treating chemistry dispenser 54 is exterior to the cabinet 14 and can be filled with treating chemistry, and a dispense position, where the treating chemistry dispenser 54 is interior of the cabinet 14.

Non-limiting examples of treating chemistries that can be dispensed by the dispensing assembly during a cycle of operation include one or more of the following: water, detergents, surfactants, enzymes, fragrances, stiffness/sizing agents, wrinkle releasers/reducers, softeners, antistatic or electrostatic agents, stain repellents, water repellents, energy reduction/extraction aids, antibacterial agents, medicinal agents, vitamins, moisturizers, shrinkage inhibitors, and color fidelity agents, and combinations thereof. The treating chemistries can be in the form of a liquid, powder, or any other suitable phase or state of matter.

Additionally, the liquid supply assembly and treating chemistry dispenser 54 can differ from the configuration shown, such as by inclusion of other valves, conduits, wash aid dispensers, heaters, sensors, such as water level sensors and temperature sensors, and the like, to control the flow of treating liquid through the laundry treating appliance 10 and for the introduction of more than one type of detergent/wash aid.

A liquid recirculation and drain assembly can be provided with the laundry treating appliance 10 for recirculating liquid from within the laundry holding assembly and draining liquid from the laundry treating appliance 10. Liquid supplied to the tub 34 or into the treating chamber 32 through the water inlet 58 and/or the treating chemistry dispenser 54 typically enters a space between the tub 34 and the basket 30 and can flow by gravity to the sump 60. More specifically, the sump 60 can be located in and formed in part by the bottom of the tub 34 and the liquid recirculation assembly can be configured to recirculate treating liquid from the sump 60 onto the top of a laundry load located in the treating chamber 32.

A pump 62 can be housed below the tub 34 and can have an inlet fluidly coupled with the sump 60 and an outlet configured to fluidly couple and to direct liquid to either or both a household drain 64, which can drain the liquid from the laundry treating appliance 10, or a recirculation conduit 66. In this configuration, the pump 62 can be used to drain or recirculate wash water in the sump 60. As illustrated, the recirculation conduit 66 can be fluidly coupled with the treating chamber 32 such that it supplies liquid from the recirculation conduit 66 into the open top of the basket 30. The recirculation conduit 66 can introduce the liquid into the basket 30 in any suitable manner, such as by spraying, dripping, or providing a steady flow of liquid. In this manner, liquid provided to the tub 34, with or without treating chemistry can be recirculated into the treating chamber 32 for treating the laundry within. The liquid recirculation and drain assembly can include other types of recirculation assemblies.

It is noted that the illustrated drive assembly, suspension assembly, liquid supply assembly, recirculation and drain assembly, and dispensing assembly are shown for exemplary purposes only and are not limited to the assemblies shown in the drawings and described above. For example, the liquid supply and recirculation and pump assemblies can differ from the configuration shown in FIG. 1, such as by inclusion of other valves, conduits, sensors (such as liquid level sensors and temperature sensors), and the like, to control the flow of liquid through the laundry treating appliance 10 and for the introduction of more than one type of treating chemistry. For example, the liquid supply assembly can be configured to supply liquid into the interior of the basket 30 or into the interior of the tub 34 not occupied by the basket 30, such that liquid can be supplied directly to the tub 34 without having to travel through the basket 30. In another example, the liquid supply assembly can include a single valve for controlling the flow of water from the household water source. In another example, the recirculation and pump assembly can include two separate pumps for recirculation and draining, instead of the single pump 62 as previously described.

The laundry treating appliance 10, and specifically the liquid supply and/or recirculation and drain assemblies, can be provided with a heating assembly (not shown), which can include one or more devices for heating laundry and/or to heat liquid provided to the treating chamber 32 as part of a cycle of operation, such as, for example, a steam generator, which can be any suitable type of steam generator, such as a flow through steam generator or a tank-type steam generator, and/or a sump heater. Alternatively, the sump heater can be used to generate steam in place of or in addition to the steam generator. In one example, the heating assembly can include a heating element provided in the sump 60 to heat liquid that collects in the sump 60. Alternatively, the heating assembly can include an in-line heater that heats the liquid as it flows through the liquid supply, dispensing and/or recirculation assemblies.

The laundry treating appliance 10 can further include a control assembly, illustrated herein as a controller 70, for controlling the operation of the laundry treating appliance 10 and coupled with various working components of the laundry treating appliance 10 to control the operation of the working components and to implement one or more treating cycles of operation. The control assembly can include the controller 70 located within the cabinet 14 and a user interface 26 that can be operably coupled with the controller 70. The user interface 26 can provide an input and output function for the controller 70.

The user interface 26 can include one or more knobs, dials, switches, displays, touch screens and the like for communicating with the user, such as to receive input and provide output. For example, the displays can include any suitable communication technology including that of a liquid crystal display (LCD), a light-emitting diode (LED) array, or any suitable display that can convey a message to the user. The user can enter different types of information including, without limitation, cycle selection and cycle parameters, such as cycle options. Other communications paths and methods can also be included in the laundry treating appliance 10 and can allow the controller 70 to communicate with the user in a variety of ways. For example, the controller 70 can be configured to send a text message to the user, send an electronic mail to the user, or provide audio information to the user either through the laundry treating appliance 10 or utilizing another device such as a mobile phone.

The controller 70 can include the machine controller and any additional controllers provided for controlling any of the components of the laundry treating appliance 10. For example, the controller 70 can include the machine controller and a motor controller. Many known types of controllers can be used for the controller 70. It is contemplated that the controller is a microprocessor-based controller that implements control software and sends/receives one or more electrical signals to/from each of the various working components to implement the control software. As an example, proportional control (P), proportional integral control (PI), and proportional derivative control (PD), or a combination thereof, a proportional integral derivative control (PID), can be used to control the various components of the laundry treating appliance 10.

Figure 2:
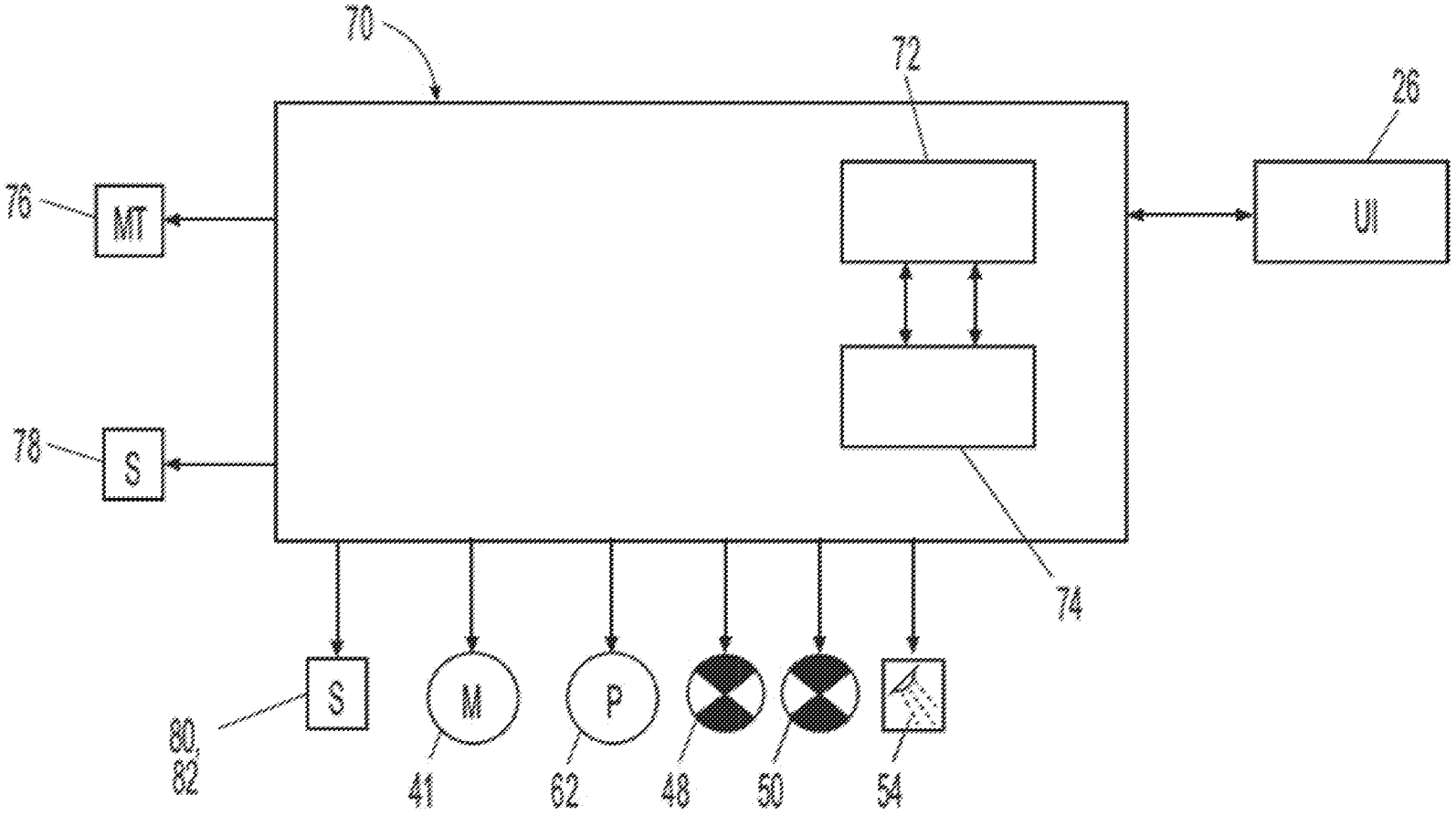
FIG. 2 is a block representation of a control assembly for controlling the operation of the laundry treating appliance of FIG. 1.

As illustrated in FIG. 2, the controller 70 can be provided with a memory 72 and a central processing unit (CPU) 74. The memory 72 can be used for storing the control software that can be executed by the CPU 74 in completing a cycle of operation using the laundry treating appliance 10 and any additional software. For example, the memory 72 can store a set of executable instructions including at least one user-selectable cycle of operation. Examples, without limitation, of treating cycles of operation include: wash, heavy duty wash, delicate wash, quick wash, pre-wash, refresh, rinse only, and timed wash, which can be selected at the user interface 26. The memory 72 can also be used to store information, such as a database or table, and to store data received from the one or more components of the laundry treating appliance 10 that can be communicably coupled with the controller 70. The database or table can be used to store the various operating parameters for the one or more cycles of operation, including factory default values for the operating parameters and any adjustments to them by the control assembly or by user input.

The controller 70 can be operably coupled with one or more components of the laundry treating appliance 10 for communicating with and/or controlling the operation of the components to complete a cycle of operation. For example, the controller 70 can be coupled with the hot water valve 48, the cold water valve 50, and the treating chemistry dispenser 54 for controlling the temperature and flow rate of treating liquid into the treating chamber 32; the pump 62 for controlling the amount of treating liquid in the treating chamber 32 or sump 60; the drive assembly 40 at the motor 41 for controlling the direction and speed of rotation of the basket 30 and/or the clothes mover 100; the user interface 26 for receiving user selected inputs and communicating information to the user; and the heater assembly to control the operation of these and other components to implement one or more of the cycles of operation.

A clothes mover sensor 80 can optionally be provided to determine the presence/absence of the agitator 150 or the impeller 120. The sensor 80 can be any suitable type of clothes mover sensor 80 configured to determine the presence or absence of the associated component, herein the agitator 150 or the impeller 120, and provide an output to the controller 70 indicative of the presence or absence of the component. Non-limiting examples of suitable types of clothes mover sensors 80 include optical sensors, light sensors, electrical sensors, and electromechanical sensors. In one example, the sensor 80 can be of the type in which a circuit is completed when the associated component—the agitator 150 or impeller 120—is present and the completion of the circuit is provided as an output to the controller 70 to indicate the presence of the associated component. In another example, the sensor 80 can include an optical sensor or a light sensor in which a light source provides illumination that is detected by a suitable detector (not shown) when the associated component, the agitator 150 or impeller 120, is not present and when the associated component is present, the illumination is blocked. The detector (not shown) can be configured to output a signal indicative of the presence or absence of the component to the controller 70 based on whether or not the illumination reaches the detector (not shown). Further aspects of the clothes mover sensor 80 are discussed in detail below with respect to FIGS. 5-16.

The controller 70 can also receive input from a temperature sensor 76, such as a thermistor, which can detect the temperature of the treating liquid in the treating chamber 32 and/or the temperature of the treating liquid being supplied to the treating chamber 32. The controller 70 can also be coupled with one or more additional sensors 78 provided in one or more of the assemblies of the laundry treating appliance 10 to receive input from the various additional sensors 78, which are known in the art and not shown for simplicity. Non-limiting examples of additional sensors 78 that can be communicably coupled with the controller 70 include a weight sensor, a moisture sensor, a chemical sensor, a position sensor, an imbalance sensor, a load size sensor, and a motor torque sensor, which can be used to determine a variety of assembly and laundry characteristics, such as laundry load inertia or mass.

Figure 3:
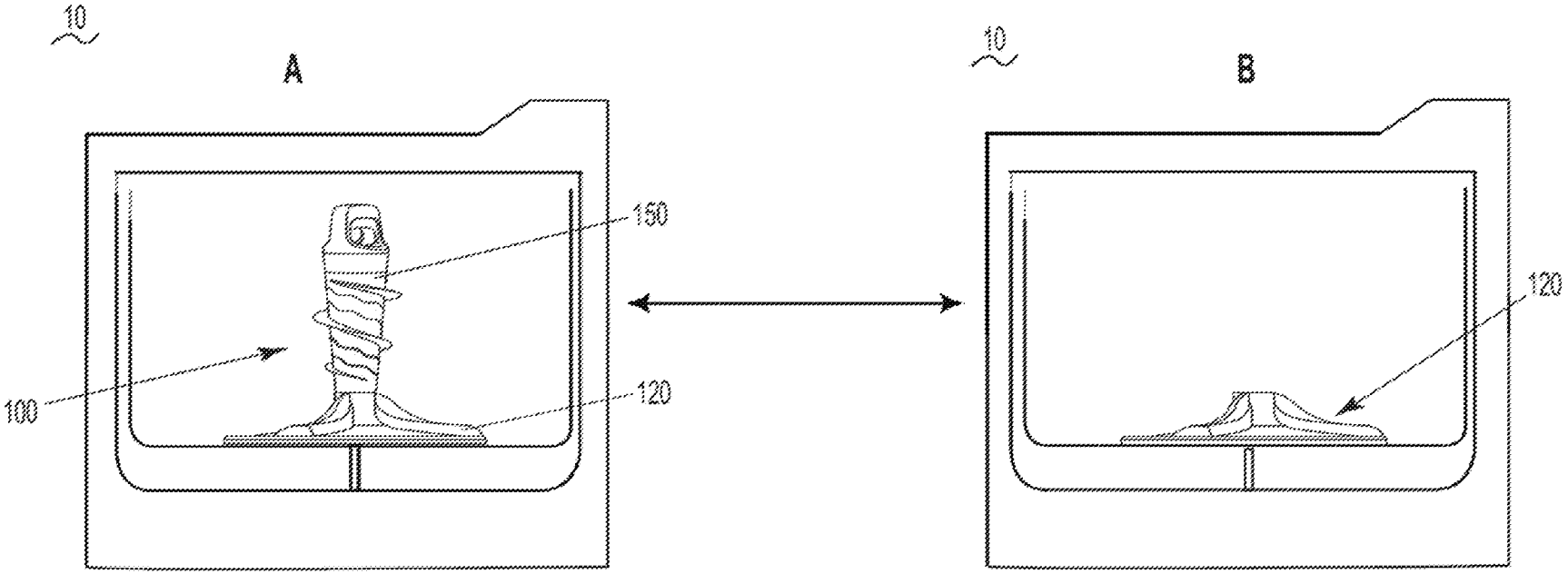
FIG. 3 is a cutaway view of the laundry treating appliance and the clothes mover of FIG. 1 with the clothes mover shown in first and second configurations.

Referring now to FIG. 3, the laundry treating appliance 10 as described herein allows the user to customize the laundry treating appliance 10 for treating the laundry load or loads to be treated. For example, the laundry treating appliance 10 can be utilized and operated with one of at least two different configurations, each utilizing a different type of clothes mover 100, the configurations selectable based on the user's treatment needs. Aspects of the laundry treating appliance 10 described herein allow the user to selectively assemble and disassemble the agitator 150, which can be thought of as forming a second clothes mover, and the impeller 120, which can be thought of as a first clothes mover, to configure the laundry treating appliance 10 into one of the two configurations. The user can customize the clothes mover 100 based on the user's personal preferences, based on the amount and/or type of mechanical action implemented by the different configurations of the clothes mover 100, and/or based on characteristics of the laundry items to be treated, non-limiting examples of which include an amount of laundry items to be treated, a size of the laundry item(s) to be treated, soil level of the laundry items, an amount and/or type of mechanical energy to be applied to the laundry items, the type of fabric of the laundry items (e.g., whether the laundry is delicate or rugged), and a fill level of liquid during treatment.

The laundry treating appliance 10 can be configured in a first configuration, illustrated by way of example as a configuration A as shown, and also as illustrated in FIG. 1, by assembling the agitator 150 with the impeller 120 within the laundry treating appliance 10. In the configuration A, the user can elect to use the clothes mover 100 that includes the agitator 150 for treating a laundry load. Such a configuration as configuration A can be useful if the user wishes to implement a treatment mode using agitator-based washing, such as for imparting significant or high quantities of mechanical action onto particularly soiled laundry items, or if the user wishes to perform deep water washing, or based on any other user preference for the clothes mover 100 and the agitator 150, such as a personal preference.

In another example, the laundry treating appliance 10 can also be configured in a second configuration, illustrated by way of example as a configuration B as shown, by assembling only the impeller 120 within the laundry treating appliance 10 and decoupling or removing the agitator 150. In the configuration B, the user elects to use the clothes mover 100 with the lower profile impeller 120 and that does not include the agitator 150 or any similar agitator post. Such a configuration as configuration B can be useful if the user wishes to implement a treatment mode using impeller-based washing, such as for low water washing, for gentler washing, wherein a lower mechanical action is imparted to the laundry items, or for washing bulky items such as blankets or comforters that could tangle around the agitator 150. Larger, bulky laundry items generally do not fit well in the basket 30 when a vertical-oriented agitator-type clothes mover 100, such as configuration A including the agitator 150, is present. Thus, the user can selectively configure the laundry treating appliance 10 to utilize the only the impeller 120 as illustrated in the configuration B, without the agitator 150 extending upward into the treating chamber 32, for use in treating large and/or bulky loads or to implement a low water treatment mode, for example, or based on another preference of the user, such as a personal preference.

The components of the laundry treating appliance 10 are configured to allow the user to configure and re-configure the laundry treating appliance 10 into either of the agitator 150 configuration A and the impeller 120 configuration B as desired. The user can select either of the configurations A or B based on personal preference of utilizing the particular type of clothes mover 100 of configuration A or B over the other, the desired cycle of operation to be implemented, and/or characteristics of the laundry items or the laundry load.

Turning now to the process or method of configuring or re-configuring the clothes mover 100, to operate the laundry treating appliance 10 and to utilize configuration A in which the agitator 150 is present in the laundry treating appliance 10, the user can assemble the agitator 150 in the laundry treating appliance 10, such as by coupling or assembling the agitator 150 to the impeller 120 to form the clothes mover 100. The user can then utilize the laundry treating appliance 10 to implement a cycle of operation on a load of laundry in a conventional manner. When the agitator 150 is configured to be supported at least in part by the impeller 120, configuration A will include the impeller 120. Optionally, if the agitator 150 does not require the impeller 120 for support, such as when the agitator 150 can be supported by the basket 30, configuration A does not have to include the impeller 120. In this alternative configuration A, the impeller 120 does not have to be present and the clothes mover 100 can be utilized with just the agitator 150.

To operate the laundry treating appliance 10 and to utilize configuration B in which only the impeller 120 is present in the laundry treating appliance 10, the removable agitator 150 is disassembled or uncoupled from the impeller 120 by the user and removed from the laundry treating appliance 10, and the impeller 120 is assembled within the basket 30. To assemble the impeller 120 within the basket 30, the agitator 150 can be configured to separate from the impeller 120 while the impeller 120 remains coupled with the drive assembly 40 and the motor 41. The user can then utilize the laundry treating appliance 10 to implement a cycle of operation on a load of laundry in a conventional manner. The impeller 120 is configured to operate as the clothes mover 100 of configuration B, that is different than the clothes mover 100 of configuration A and independent of the agitator 150, during a cycle of operation. In this manner, the laundry treating appliance 10 can be selectively re-configured by the user between the first and second configurations as illustrated to utilize two different clothes movers 100.

Further, to configure or re-configure the laundry treating appliance 10 from the first configuration, configuration A, to the second configuration, configuration B, the user removes or decouples the agitator 150 and sets it aside. Optionally, the laundry treating appliance 10 can be configured to facilitate storage of the removable agitator 150 when not in use. For example, the laundry treating appliance 10 can include a storage element that suspends the removable agitator 150 from the laundry treating appliance 10, such as a hook, clamp, hanger, or suspending rod. In another example, the storage element can be in the form of a shelf, drawer, or cavity configured to support the removable agitator 150. In another aspect of the disclosure, a companion laundry dryer or laundry module can include the storage element configured to store the removable agitator 150.

In one aspect of the present disclosure, the laundry treating appliance 10 can be provided to the user in configuration B in which the laundry treating appliance 10 includes only the impeller 120. The agitator 150 can be offered to the user as a kit that can optionally be used with the laundry treating appliance 10. The laundry treating appliance 10 can be configured for use as is in configuration B and optionally for use with the kit components, including at least the agitator 150. In this manner, the user has the option to customize the laundry treating appliance 10. A kit according to an aspect of the disclosure includes any combination of clothes mover 100 components and related components that allow the laundry treating appliance 10 to be selectively configured by the user into different clothes mover 100 configurations.

Further, multiple different kits including different agitators 150 and/or different options of removable agitators 150 can be made available to the user for customizing the laundry treating appliance 10. For example, agitators 150 having different features, such as different shapes or blade or vane configurations can be provided. In one example, one option can include an agitator 150 having an auger-style blade, whereas another option can include an agitator 150 having vertically extending blades.

By way of further non-limiting example, kits including agitators 150 having different options can be provided. For example, a kit can include a different style of removable agitator 150 based on the configuration of the impeller 120, the manner in which the removable agitator 150 is mounted within the laundry treating appliance 10 and/or within the impeller 120, optional features of the removable agitator 150, and/or features of the laundry treating appliance 10 (e.g., based on whether the laundry treating appliance 10 has a separate liquid supply system for use with a removable agitator 150). In another example, a kit can include a removable agitator 150 in which the agitator 150 includes at least one dispenser for supplying a treating chemistry to the treating chamber 32 that are separate from the main treating chemistry dispenser 54 that supplies treating chemistry to the treating chamber 32. An alternative kit can include a removable agitator 150 that does not include separate dispensers. The different options of clothes movers 100, agitators 150, and impellers 120 can be combined as desired to form any number of different kits for use with the laundry treating appliance 10 of the present disclosure.

Figure 4:
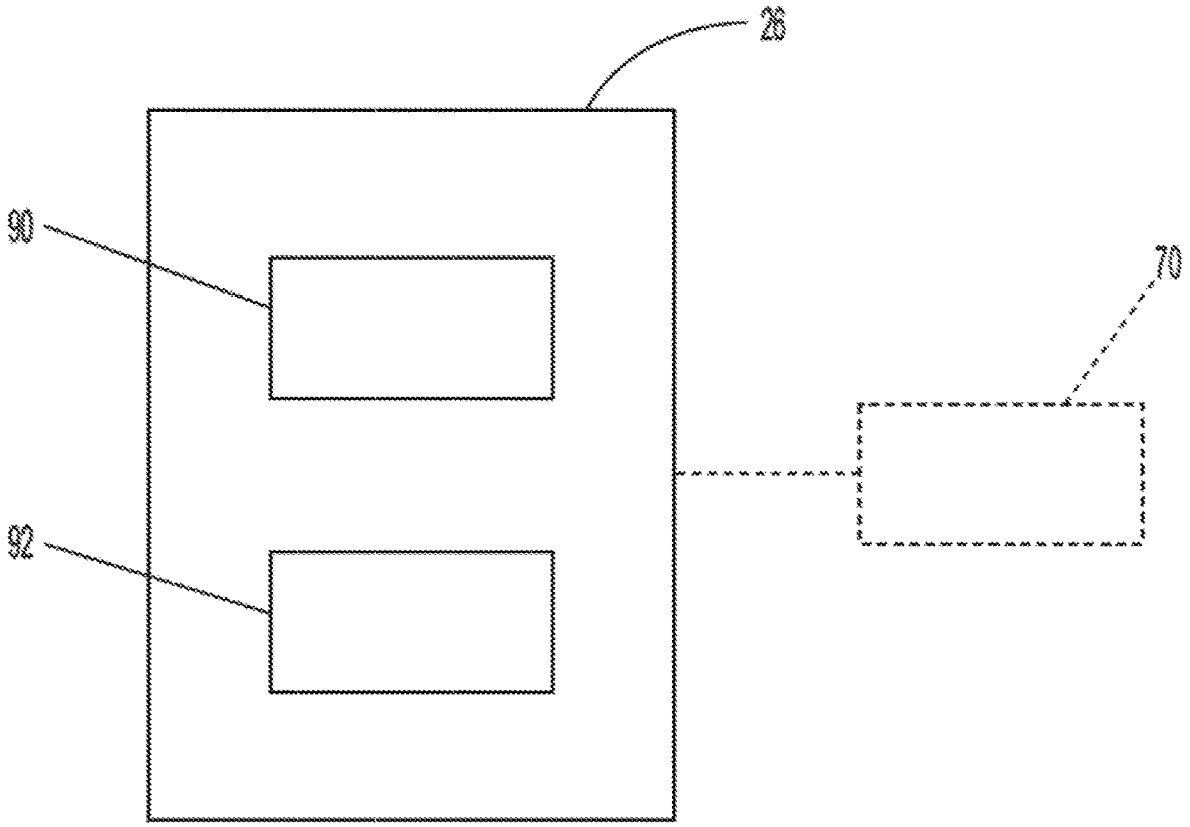
FIG. 4 is a block view of a user interface for use with the laundry treating appliance of FIG. 1.

Referring now to FIG. 4, in yet another aspect of the present disclosure, the user interface 26, or a portion of the user interface 26, can be provided with a dedicated input that can be selected by the user and is configured to allow the user to provide input regarding which of the configurations A or B is present, and thus also whether or not the removable agitator 150 is present, within the basket 30 to be utilized to treat laundry items within the laundry treating appliance 10. The user interface 26 can include an indicator 90 for indicating configuration A and an indicator 92 for indicating configuration B. Each of the indicators 90, 92 can be actuatable by the user and utilized to communicate to the controller 70 which of the configurations A and B will be present during the impending cycle of operation. Alternatively, the indicators 90, 92 themselves are not selectable and a separate selector actuator is provided for cycling through each of the options indicated by the indicators 90, 92. The user can utilize the indicators 90, 92 before or after assembling the desired configuration A or B.

Turning now to the operation of the laundry treating appliance 10, and specifically based upon the presence or absence of the agitator 150, and thus the use of configuration A or B, the user can select a cycle of operation through the user interface 26 for implementation by the controller 70 in treating the laundry items in the basket 30. The controller 70 can be configured to implement a cycle of operation with the basket 30 and the clothes mover 100 in the same manner or in a different manner based on the presence or absence of the removable agitator 150. In one example, the controller 70 can be configured to implement the same cycles of operation independent of the presence of the agitator 150. In another aspect, the controller 70 can be configured to implement at least one different cycle of operation based on the presence of the agitator 150 and of either configuration A or B. For example, the basket 30 and/or the clothes mover 100 can be rotated in a different manner when the removable agitator 150 is present compared to when the removable agitator 150 is absent, even if the user selects the same cycle of operation to be implemented using the basket 30.

Optionally, the controller 70 can control the information and selectable options available through the user interface 26 based on which of the indicators 90, 92 is selected by the user, such that the user interface 26 can be configured to allow the user to select from a predetermined set of cycles of operation, including cycle options, based on the input regarding the presence or absence of the agitator 150. In one example, the user interface 26 can be configured to display a first set of predetermined selectable cycles of operation when the agitator 150 is present and a second set of predetermined selectable cycles of operation when the agitator 150 is absent and only the impeller 120 is present. The first and second sets of predetermined selectable cycles of operation can differ by one or more cycles of operation or based on one or more selectable cycle options for a given set of selectable cycles of operation.

Alternatively, or additionally, the controller 70 can use the indicators 90, 92 to indicate to the user which configuration A or B to utilize based on the user's selection of the impending cycle of operation and/or one or more selected cycle options. For example, if the user indicates through the user interface 26 that the laundry items to be washed include a bulky item (e.g., a blanket or comforter), the user interface 26 can be configured to communicate to the user through indicator 92 that configuration B is recommended for use in implementing the cycle of operation. The user can then remove the agitator 150, if the agitator 150 has not already been removed, and implement the selected cycle of operation using the recommended configuration B. In another example, if the user indicates through the user interface 26 that the laundry load includes heavily soiled items, the controller 70 can be programmed to control the user interface 26 to indicate to the user through indicator 90 that configuration A with the agitator 150 is recommended.

Similarly, instead of indicating to the user that a particular configuration A, B is recommended for use based upon the user's selection of the impending cycle of operation and/or one or more selected cycle options, the controller 70 can instead be configured to make a determination of the presence or absence of the removable agitator 150 based on the cycle of operation selected by the user. For example, if the user indicates through the user interface 26 that the laundry items to be washed include a bulky item (e.g., a blanket or comforter), the user interface 26 can be configured to communicate to the user through indicator 92 that the controller 70 has determined that the removable agitator 150 is present based upon the cycle of operation selected by the user.

The user interface 26 can include graphics and/or text to indicate to the user which configuration A, B is recommended or has been determined based upon the cycle of operation selected by the user and/or to allow the user to communicate the configuration A, B to the controller 70. In one example, the user interface 26 can include graphics representative of either of the possible configurations A or B, and the user interface 26 can be configured to illuminate the graphic corresponding to the recommended or determined configuration A, B. For example, each of the indicators 90, 92 can include a graphic representative of each configuration A, B, which is illuminated based on the user's selection and/or based on the configuration A, B recommended or determined by the controller 70.

Optionally, the controller 70 can be provided with information regarding which of the configurations A or B is present based on input information from the clothes mover sensor 80 to determine the presence or absence of the removable agitator 150. In this way, the presence or absence of the removable agitator 150 can be determined automatically based upon input information from using the clothes mover sensor 80, can be determined based upon user input through the user interface 26, or a combination of both. The controller 70 can optionally use the input information from the clothes mover sensor 80 to illuminate one of the indicators 90, 92 to communicate to a user that a particular configuration A, B is present.

As described herein, the sensor 80 can be provided to determine the presence or absence of the agitator 150 or the impeller 120 and provide an output to the controller 70 accordingly. More specifically, and with respect to the configurations A and B, the presence or absence of the agitator 150, and thus of either of the configurations A and B, can be determined based on input from the clothes mover sensor 80. The clothes mover 100 can include the clothes mover sensor 80 configured to determine the presence or the absence of the agitator 150. When the agitator 150 is present, i.e., is coupled to the impeller 120, the sensor 80 can provide an output to the controller 70 indicating that the agitator 150 is present. When the agitator 150 is absent, i.e., is uncoupled from the impeller 120, the sensor 80 can provide an output to the controller 70 that the agitator 150 is absent, indicating that only the impeller 120 is present. Further details of the operation of the clothes mover sensor 80 are discussed in detail with respect to FIGS. 5-16.

Figure 5:
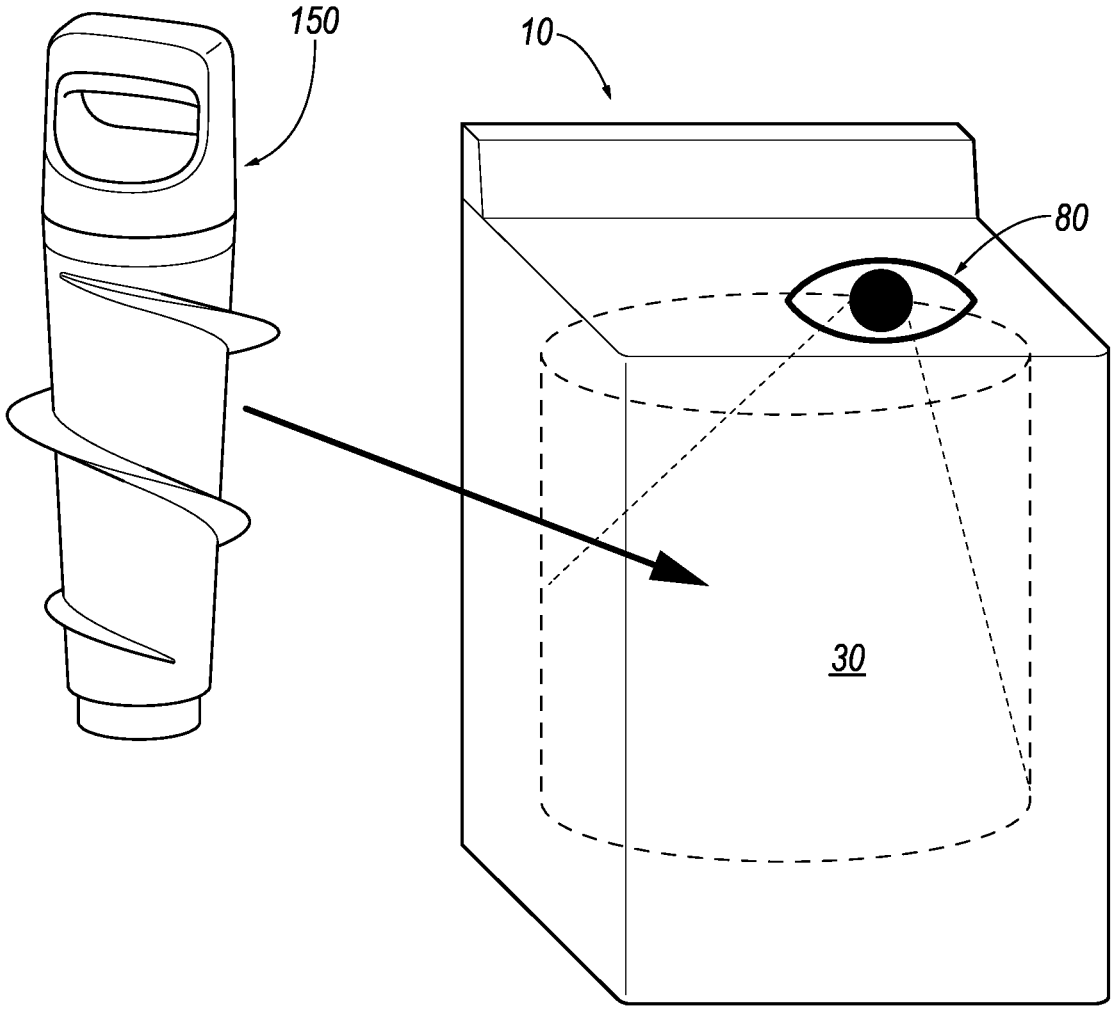
FIG. 5 is an example implementation of the clothes mover sensor as an image sensor.

FIG. 5 is an example implementation of the clothes mover sensor 80 as an image sensor. As shown, the image sensor aimed into the basket 30 to view the interior of the basket 30 of the laundry treating appliance 10. This allows image data to be captured of the location within the laundry treating appliance 10 where the removable agitator 105 may or may not be installed.

The image sensor may of various sensor types that detect and convey information used to make an image. For instance, the image sensor may be an electronic image sensor such as a charge-coupled device (CCD) or an active-pixel sensor complementary metal oxide semiconductor (CMOS) sensor. In some examples, the image sensor may provide a light intensity signal for each of a plurality of pixels of the image, regardless of color. In other examples, the image sensor may provide a color image. For instance, in one implementation the image sensor may use a color filter array that passes red, green, and blue light to selected pixels of the sensor to allow for a color image to be constructed.

The controller 70 may receive the image data from the image sensor. The controller 70 may further use computer vision software to detect the presence of the removable agitator 150 (or other accessories) within the basket 30. For instance, this software may be programmed to learn and then recognize one or several pre-specified or learned objects or object classes. The learning may be accomplished using a set of image data of instances with and without removable agitator 150 that is collected and annotated to indicate the presence of absence of the removable agitator 150. This data may be used to train a machine learning system, such as a deep learning neural network. Once trained, the machine learning system may receive images from the image sensor and determine whether or not the removable agitator 150 is present (or if so, what type of removable agitator 150 is present). This learning and runtime operation may be aided by using consistent imaging location (or locations) within the basket 30 provided according to the fixed location of the image sensor (or sensors) within the laundry treating appliance 10. Thus, using the image data, the controller 70 may determine whether the laundry treating appliance 10 is operating in configuration A or in configuration B.

In addition to detecting the presence of the removable agitator 150, the image sensor implementation of the clothes mover sensor 80 may be used for other applications as well. In an example, the controller 70 may be used to receive the image data from the image sensor to monitor the motion of the load and dynamically tune the aggressiveness of wash. Seminal machine learning techniques may be used on the image data from the image sensor to determine the aggressiveness of the wash. For loads that are moving poorly, the controller 70 may increase the aggressiveness of the agitation stroke. For loads that are moving very well, the controller 70 may reduce the aggressiveness to prevent damage and/or tangling.

In another example, the clothes mover sensor 80 may be used to monitor for off-balance load detection. For instance, detection of a high contrast bottom of the basket 30 or visual characteristics of the water flow in the basket 30 may be learned by the controller 70. If an off-balance load is detected, the controller 70 may take various actions, such as to provide an alert to the user of the off-balance condition in the user interface 26, stop the wash cycle, etc.

In yet another example, the clothes mover sensor 80 may be used to detect the type of loads (colors vs whites) and modify cycle behavior. For instance, if the image sensor is a color image sensor, color data from the sensor may be used by the controller 70 to determine whether the basket 30 is filled with a load of white laundry or a load of laundry having colors. This determination may be used by the controller 70 for various purposes, such as to adjust the treating chemistry or water provided into the tub 34, and/or to adjust the aggressiveness of the wash cycle.

Figure 6:
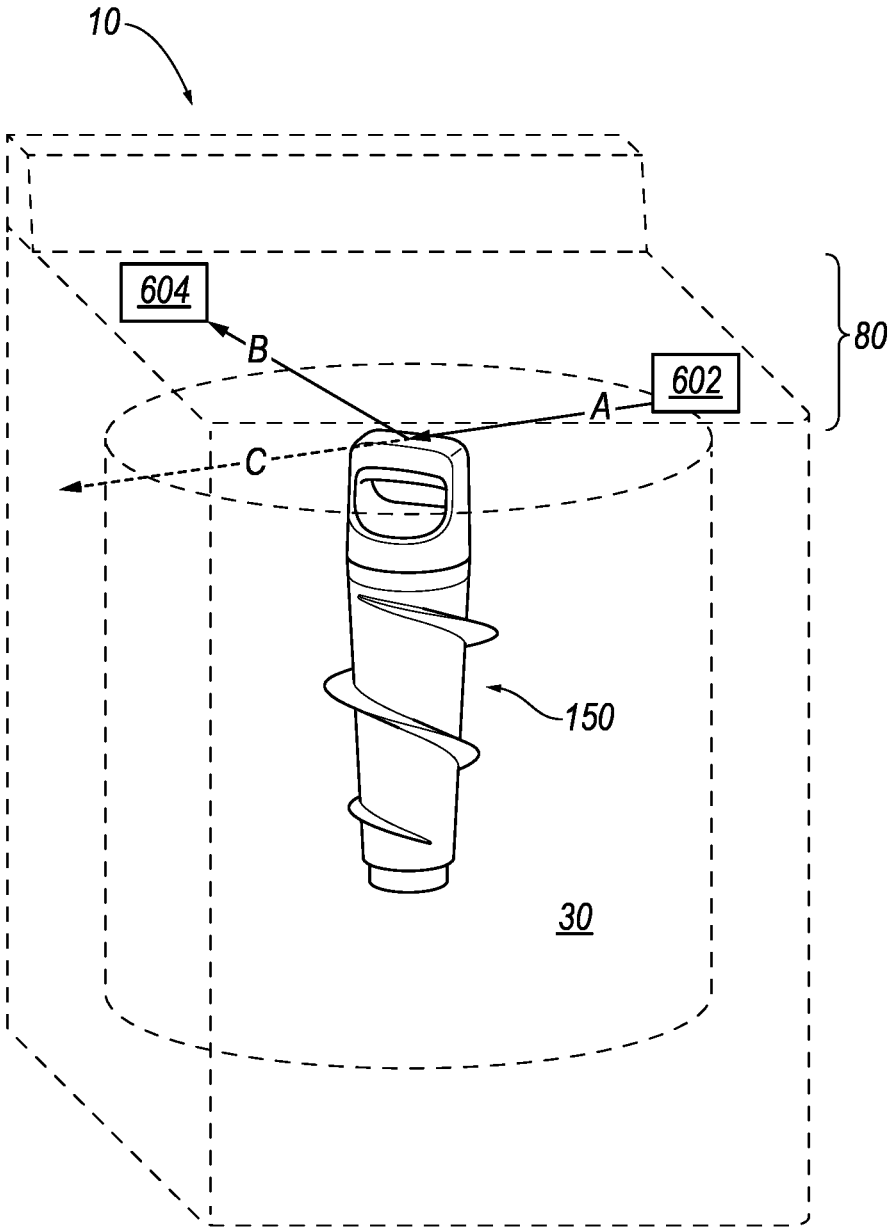
FIG. 6 is an example implementation of the clothes mover sensor as a reflectance spectroscopy sensor.

FIG. 6 is an example implementation of the clothes mover sensor 80 as a reflectance spectroscopy sensor. Reflectance spectroscopy is an approach to measuring the absorption spectra of items. These measurements may be made in the visible region of the electromagnetic spectrum, although measurements of other wavelengths, such as near-infrared may additionally or alternatively be used. Using reflectance spectroscopy, the controller 70 may utilize reflected color information to detect the presence or absence of the removable agitator 150, as well as the type of removable agitator 150, if attached.

A light source 602 may be included within the laundry treating appliance 10. The light source 602 may be an LED, fluorescent, or other light-emitting device configured to provide electromagnetic energy in the infrared visible or other wavelength. A sensor 604 may also be installed within the laundry treating appliance 10. The sensor may be similar to the image sensor discussed above with respect to FIG. 5.

Light from the light source 602 (shown by arrow A) may be reflected off the top surface of the removable agitator 105 (shown by arrow B) and be detected by the sensor 604. When a removable agitator 150 installed to the laundry treating appliance 10, the top surface of the handle of the removable agitator 150 may accordingly reflect light from the light source 602 into the sensor 604, informing the controller 70 that an attachment of a removable agitator 150 is in place. When the removable agitator 150 is disengaged, the light from the light source 602 is not reflected to the sensor 604 (shown by arrow C) causing the controller 70 to receive data from the sensor 604 indicating that the removable agitator 150 is not engaged. Thus, using the reflectance data, the controller 70 may determine whether the laundry treating appliance 10 is operating in configuration A or in configuration B.

Figure 7:
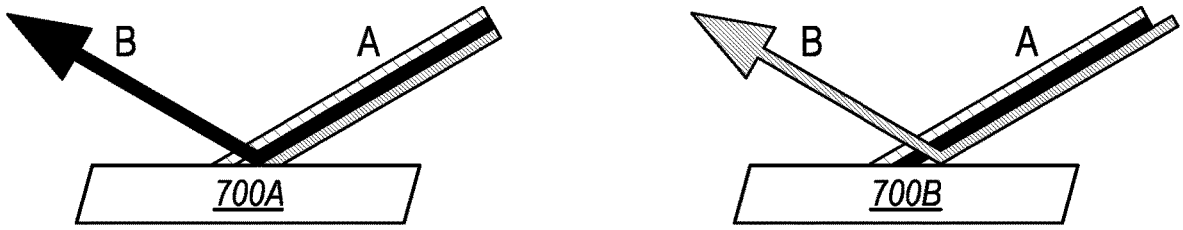
FIG. 7 is an example illustration of the reflectivity of different surfaces.

As shown in FIG. 7, different attachments could reflect different wavelengths of light, depending on the absorption characteristics of the reflecting surface 700A and 700B (more generally reflecting surface 700). With respect to the reflecting surface 700A, the reflecting surface 700A receives light from the light source 602 (shown by arrow A). Upon contact with the reflecting surface 700A, the red light is reflected (shown by arrow B), but the yellow and blue light is absorbed. This red light may then continue on to be detected by the sensor 604. With respect to the reflecting surface 700B, the reflecting surface 700B again receives light from the light source 602 (shown by arrow A). Upon contact with the reflecting surface 700B, the blue light is reflected (shown by arrow B), but the yellow and red light is absorbed. This blue light may then continue on to be detected by the sensor 604.

Figure 8:
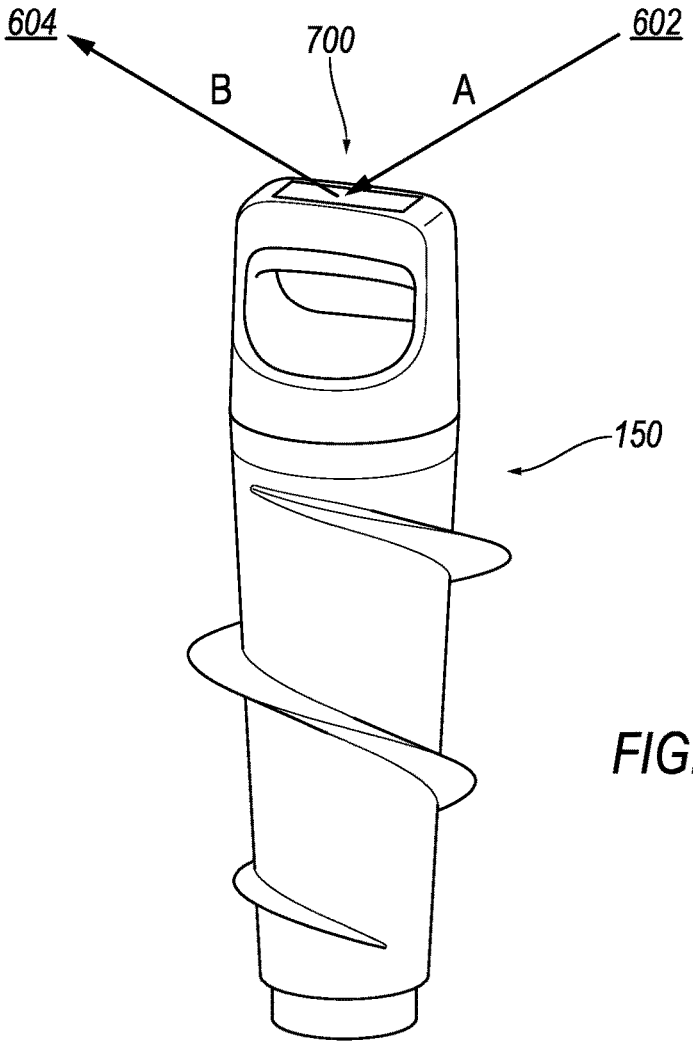
FIG. 8 is an example illustration of reflectivity of a surface on the handle of the attachment.

As shown in FIG. 8, a reflecting surface 700 may be applied to the handle portion of the removable agitator 150. Different types of removable agitator 150 may have reflecting surfaces 700 of different colors. For instance, a removable agitator 150 having embedded filter capabilities may have a reflecting surface 700 of a first color, a removable agitator 150 having embedded laundry treatment capabilities may have a reflecting surface 700 of a second color, a removable agitator 150 for heavily soiled loads may have a reflecting surface 700 of a third color, etc.

During operation of the laundry treating appliance 10, the light source 602 may be activated, and the sensor 604 may be further used to detect the color of the reflecting surface 700. The controller 70 may receive this data from the sensor 604, and using the color information, the controller 70 may detect which type of attachment is engaged, allowing for performance of different behaviors by the laundry treating appliance 10 based on attachment type.

Figure 9:
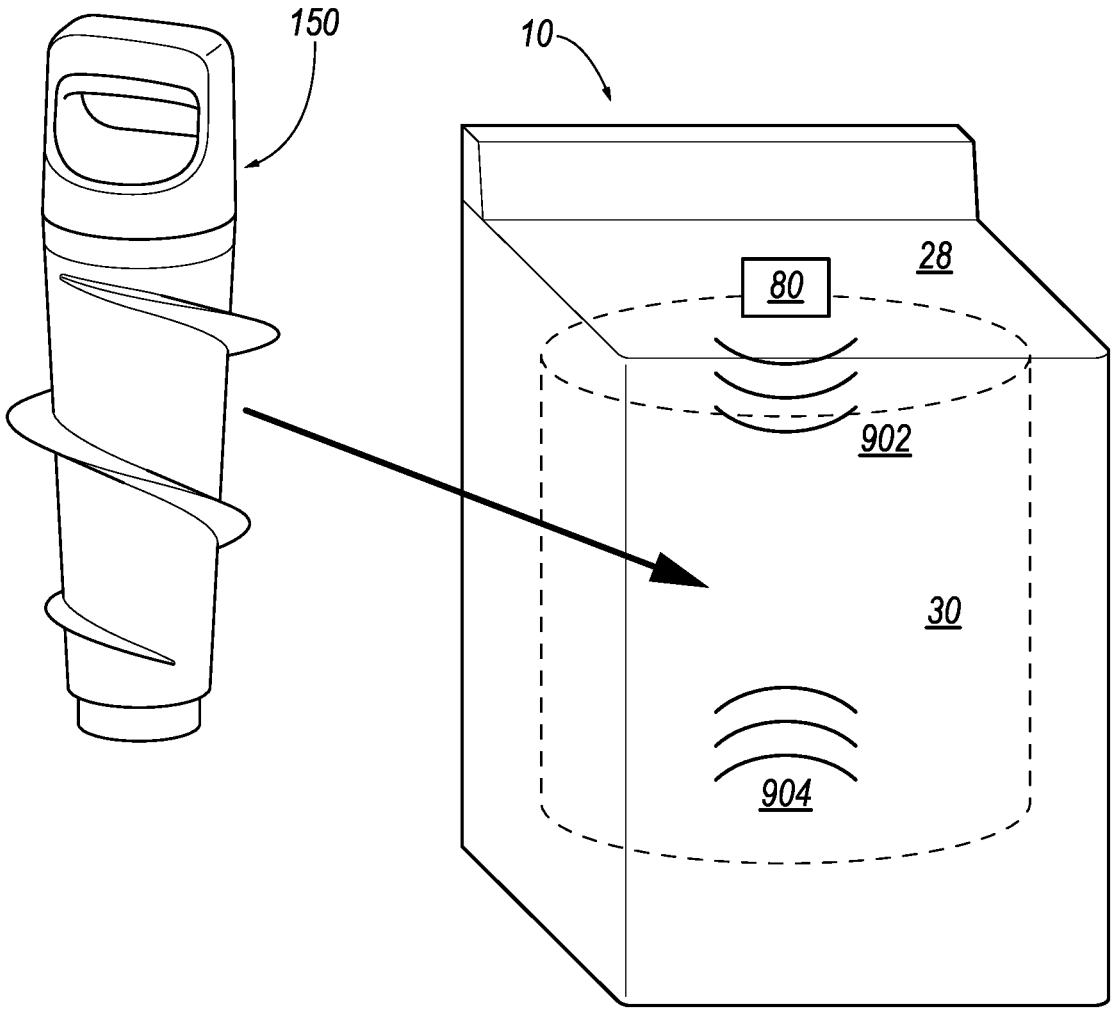
FIG. 9 is an example implementation of the clothes mover sensor as an ultrasonic sensor.

FIG. 9 is an example implementation of the clothes mover sensor 80 as an ultrasonic sensor. In an example, an ultrasonic sensor may be mounted in the lid 28 of the laundry treating appliance. Ultrasound generally refers to sound above the level of human hearing range. Although ultrasound typically starts at 20 KHz, many ultrasonic transducers produce sound energy at 200 KHz or even higher. The ultrasonic sensors send a sound pulse in the ultrasonic range and measure the time it takes an echo of the sound pulse to return. As the speed of sound is known, the ultrasonic sensor may be used to determine the distance of a target from the sensor.

As shown in FIG. 9, the ultrasonic sensor may send a signal 902 downward into the basket 30 and waits for a return signal 904. As the ultrasonic sensor is placed such that sound would reflect off the removable agitator 150, a shorter ping time may represent the presence of the removable agitator 150, while a longer ping time may represent absence of the removable agitator 150. The ultrasonic sensor may therefore be used to provide a signal to the controller 70 to allow the controller 70 to detect the presence of a removable agitator 150 or other accessory that utilizes the removable agitator 150 connection. Thus, using the ultrasonic return time data, the controller 70 may determine whether the laundry treating appliance 10 is operating in configuration A or in configuration B.

In addition to detecting the presence of the removable agitator 150, the ultrasonic clothes mover sensor 80 may be used for other applications as well. These applications may include, for example, load size information, such as how high the load is in the basket 30, and/or water level sensing in the basket 30.

Figure 10:
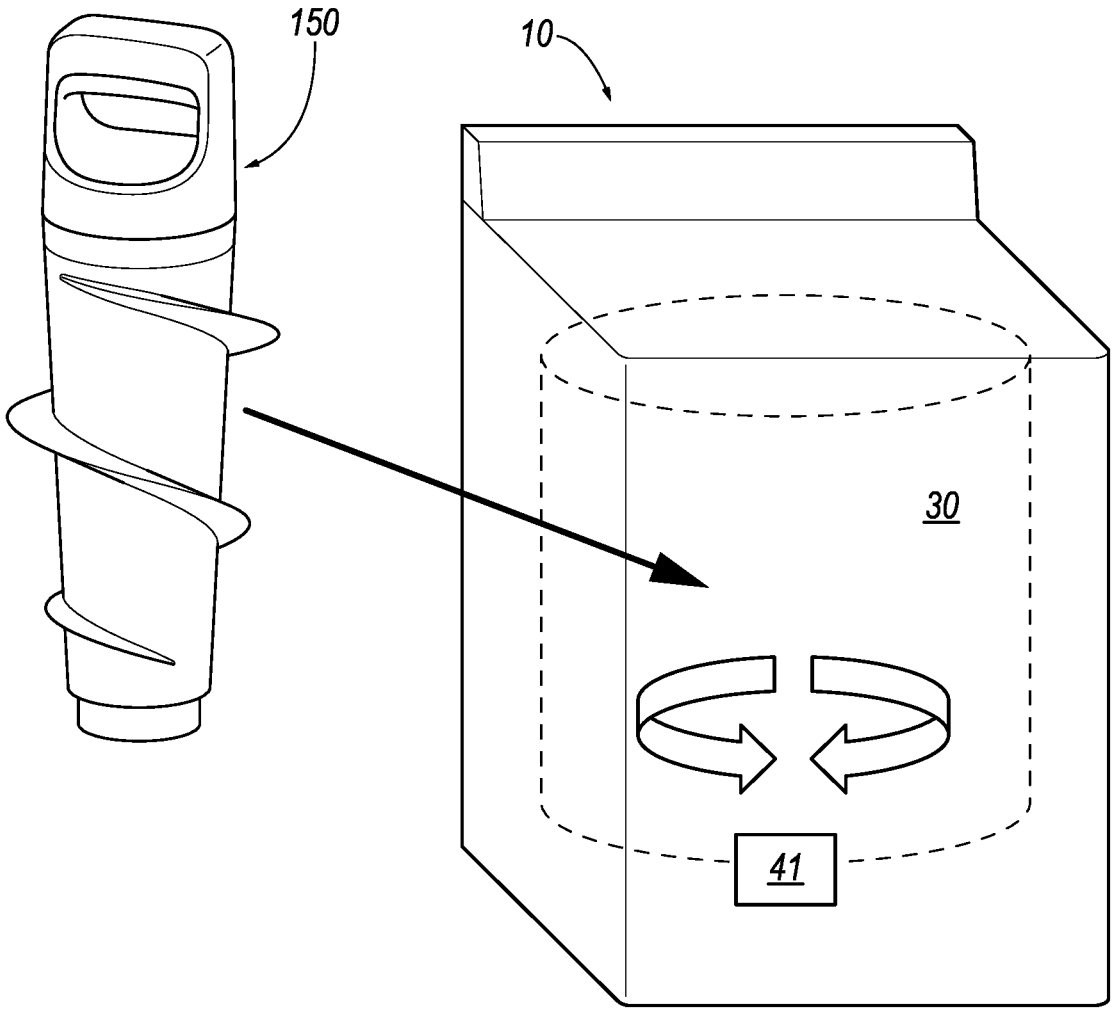
FIG. 10 is an example implementation of the clothes mover sensor via torque sensing.

FIG. 10 is an example implementation of the clothes mover sensor 80 via torque sensing. In this implementation, the motor 41 of the appliance may be used as the clothes mover sensor 80 to detect the presence of a barrel of the removable agitator 150. By sensing the current passing through the motor 41 during agitation and/or by detecting stall conditions of the motor 41, the controller 70 may determine the presence or absence of the removable agitator 150.

For example, the power utilized by the motor 41 in rotating the clothes mover 100 when including the agitator 150 at a first speed or acceleration may be different than the power utilized by the motor 41 in rotating the clothes mover 100 with only the impeller 120, such that the agitator 150 is absent, at the same speed or acceleration. These predefined values may include, for example, measurements in different cycle conditions (e.g., no water, vs. low water, vs. deep water) to compare against tested conditions to make an accurate inference for current cycle conditions. The difference in power can be identified by the controller 70 and compared to predefined values for presence or absence of the agitator 150 to determine whether the agitator 150, and thus the configuration A or configuration B, is present.

In addition to detecting the presence of the removable agitator 150, the torque sensing approach to the clothes mover sensor 80 may be used for other applications as well. These applications may include, for example, stall detection of the motor 41 and/or torque estimation of the motor 41. Moreover, the controller 70 may optionally be configured to alter one or more aspects of the selected cycle of operation based on the determination of the presence or absence of the agitator 150. For instance, the cycle time, agitation speed, or other cycle parameters may be varied based on the presence or absence of the removable agitator 150.

Figure 11:
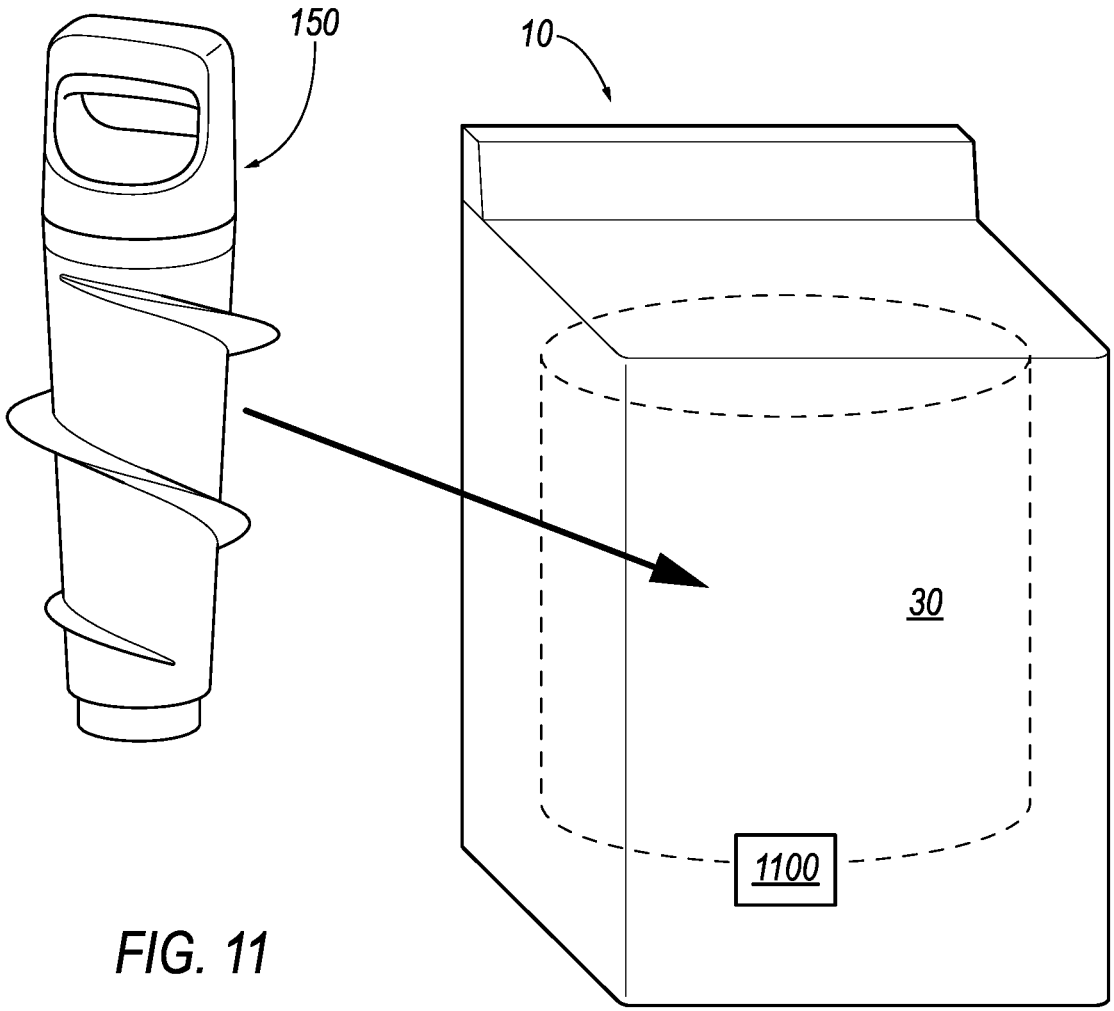
FIG. 11 is an example implementation of the clothes mover sensor using a reed sensor.

FIG. 11 is an example implementation of the clothes mover sensor 80 using a reed sensor 1100. The reed sensor 1100 or read switch is an electrical switch that changes state from open to closed upon presence of a magnetic field, such as an electromagnet or a permanent magnet. As one possibility, a magnet or magnets may be embedded in the lower end of the removable agitator 150, and the reed sensor 1100 may be embedded in the impeller 102 mount. Thus, when the removable agitator 150 engages with the impeller 120, the magnetic field of the removable agitator 150 changes the state of the reed sensor 1100. This state may be provided to the controller 70, and used by the controller 70 to determine whether the agitator 150, and thus the configuration A or configuration B, is present.

Figure 12:
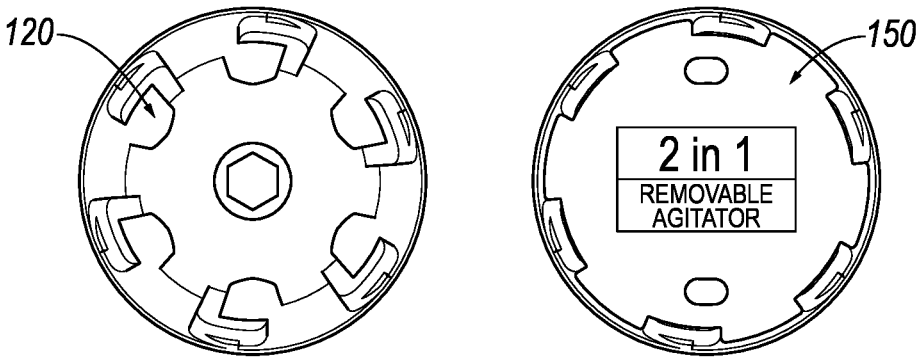
FIG. 12 is an example detail of integration of the reed sensor with the base of the removable agitator connection.

As shown in further detail in FIG. 12, to assemble configuration A, the removable agitator 150 may be aligned with the impeller 120 such that bayonet pins of the removable agitator 150 are aligned with corresponding openings of the impeller 120. The removable agitator 150 may be moved toward the impeller 120, to insert the removable agitator 150 into the impeller 120. In doing so, the bayonet pins travel into the openings of the impeller 120. The removable agitator 150 may then be rotated to move the bayonet pins into a lock portion of the impeller 120. Once rotates, a lock portion of the removable agitator 150 may fill the openings of the impeller 120, locking the removable agitator 150 in place. The reed sensor 1100 may be included in the impeller 120, and may accordingly be used to measure the displacement of the removable agitator 150 engaged from underneath the spring-loaded impeller 120 cap.

In addition to detecting the presence of the removable agitator 150, the reed sensor 1100 (as shown in FIG. 11) of the clothes mover sensor 80 may be used for other applications as well. These applications may include, for example, to alter one or more aspects of the selected cycle of operation based on the determination of the presence or absence of the agitator 150. For instance, the cycle time, agitation speed, or other cycle parameters may be varied based on the presence or absence of the removable agitator 150.

Figure 13:
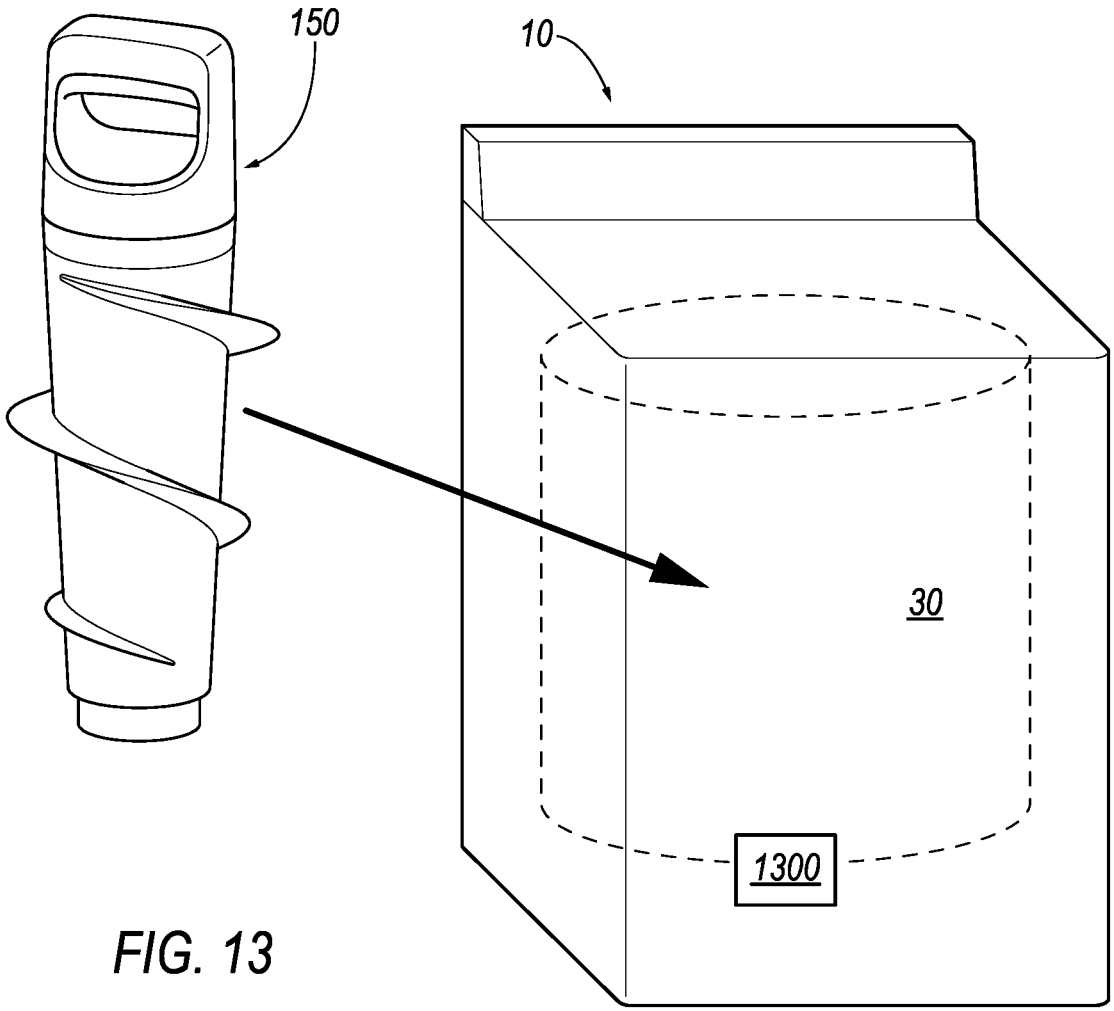
FIG. 13 is an example implementation of the clothes mover sensor using a load cell.
Figure 14:
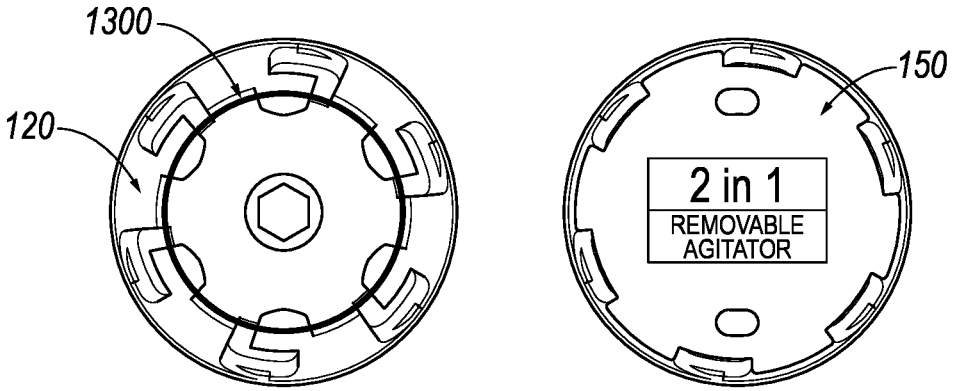
FIG. 14 is an example illustration of a detail of the integration of the load cell with the base of the removable agitator connection.

FIG. 13 is an example implementation of the clothes mover sensor 80 using a load cell 1300. In general, a load cell 1300 is a device that converts a force into a measurable electrical signal. Various types of load cells 1300 may be available, such as strain gauges, pneumatic load cells, hydraulic load cells, etc. Referring to FIG. 14, the load cell 1300 may be formed in a circular, e.g., donut shape, and may be included in the impeller 120 base assembly.

The load cell 1300 may be configured to provide a signal to the controller 70, and the controller 70 may be configured to receive the signal. When the removable agitator 150 is inserted into the impeller 120 base, a load may be placed on the load cell 1300. This may affect the signal provided by the load cell 1300 to the controller 70. The controller 70 may be programmed or calibrated with load cell 1300 signal levels that correspond to presence of the removable agitator 150, as well as with load cell 1300 signal levels that correspond to absence of the removable agitator 150. Thus, based on the current signal provided by the load cell 1300 to the controller 70, the controller 70 may determine whether the agitator 150, and thus the configuration A or configuration B, is present.

In addition to detecting the presence of the removable agitator 150, the load cell 1300 implementation of the clothes mover sensor 80 may be used for other applications as well. For instance, the cycle time, agitation speed, or other cycle parameters may be varied based on the presence or absence of the removable agitator 150.

Figure 15:
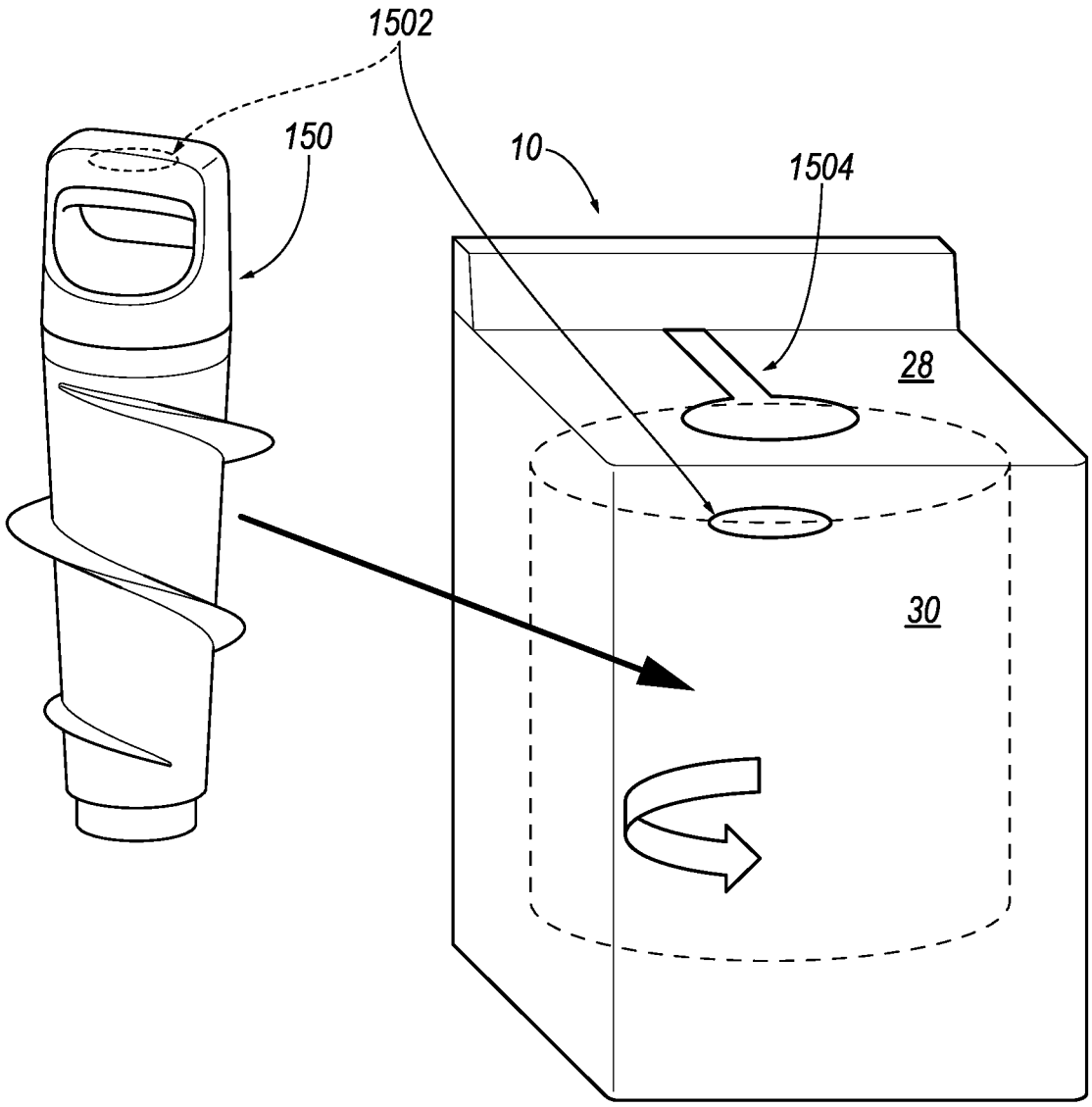
FIG. 15 is an example implementation of the clothes mover sensor using inductance.

FIG. 15 is an example implementation of the clothes mover sensor 80 using inductance. A magnet 1502 may be embedded in the top of the removable agitator 150. A conductor 1504 such as an inductive wire loop may be embedded in the lid 28. With such a setup, electromagnetic inductance may be used to detect the presence of a removable agitator 150 in the basket 30. When the basket 30 rotates, the magnet 1502 generates an electric current in a conductor 1504. This electric signal may be provided to the controller 70. Based on the presence or absence of the electric signal, the controller 70 may detect the presence or absence of the removable agitator 150. Thus, based on the signal provided by the conductor 1504 to the controller 70, the controller 70 may determine whether the agitator 150, and thus the configuration A or configuration B, is present.

In addition to detecting the presence of the removable agitator 150, the inductive approach to the clothes mover sensor 80 may be used for other applications as well. These applications may include, for example, use as a spin speed sensor when the agitator 150 is installed. As some other examples, the cycle time, agitation speed, or other cycle parameters may be varied based on the presence or absence of the removable agitator 150.

Figure 16:
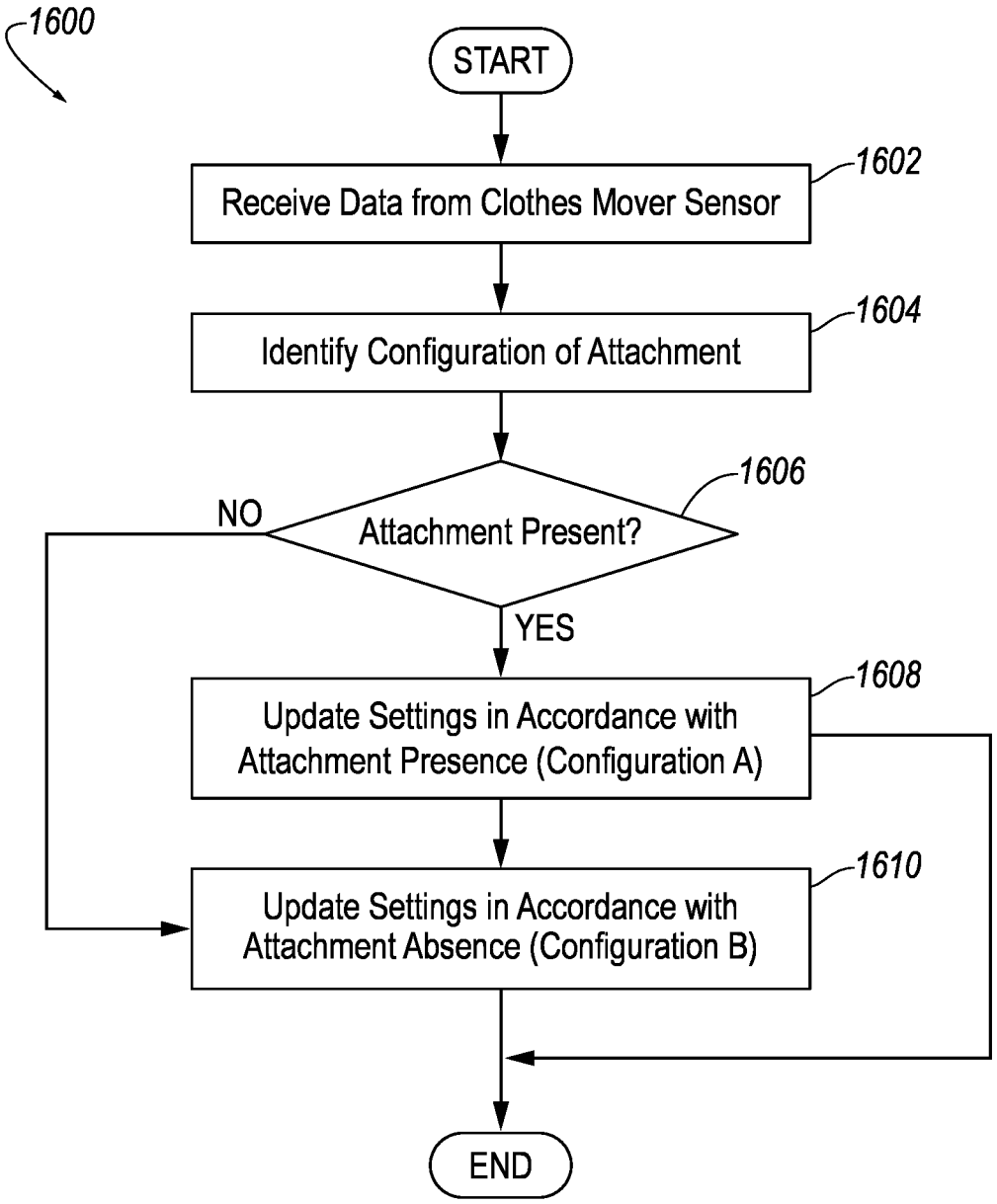
FIG. 16 is an example flowchart for operation of the controller to determine the presence or absence of the removable agitator according to data from the clothes mover sensor.

FIG. 16 is an example flowchart 1600 for operation of the controller 70 to determine the presence or absence of the removable agitator 150 according to data from the clothes mover sensor 80.

At operation 1602, the controller 70 receives data from the clothes mover sensor 80. For instance, this data may include data from an image sensor as shown in FIG. 5, data from a reflectance spectroscopy sensor as shown in FIGS. 6-8, data from an ultrasonic sensor as shown in FIG. 9, data from the motor 41 operating as a torque sensor as shown in FIG. 10, data from the reed sensor 1100 as shown in FIGS. 11-12, data from the load cell 1300 sensor as shown in FIGS. 13-14, and/or data from the conductor 1504 inductive sensor as shown in FIG. 15.

At operation 1604, the controller 70 identifies the configuration of the removable agitator 150 based on the data received from the clothes mover sensor 80. In an example, the controller 70 may use a trained machine learning system to determine presence or absence of the removable agitator 150 based on the image data from the image sensor. In another example, in a reflectance spectroscopy sensor configuration the controller 70 may use the presence or color of light received by the sensor 604 to determine whether or not the removable agitator 150 it attached, and if so, optionally what type of removable agitator 150 is attached. In yet another example, the controller 70 may use ping time determined from an ultrasonic sensor to identify presence or absence of the removable agitator 150. In still another example, the controller 70 may compare the power utilized by the motor 41 to predefined values of power measurements of the motor 41 in the current cycle conditions to identify presence or absence of the removable agitator 150. In still another example, the controller 70 may use switch state data from the reed sensor 1100 to determine presence or absence of the removable agitator 150. As an even further another example, the controller 70 may use signal level from the load cell 1300 in comparison to calibrated predefined values to determine presence or absence of the removable agitator 150. In another example, the controller 70 may use the electric current generated in the conductor 1504 to determine presence or absence of the removable agitator 150.

If the agitator is present, at operation 1606, the controller 70 transitions to operation 1608 to perform operations in accordance with the agitator 150 being present. In an example, the controller 70 updates one or more of the cycle time, agitation speed, or other cycle parameters based on the presence of the removable agitator 150.

If not, from operation 1606 the controller 70 transitions to operation 1610 to perform operations in accordance with the agitator 150 being absent. In an example, the controller 70 updates one or more of the cycle time, agitation speed, or other cycle parameters based on the absence of the removable agitator 150.

At operations 1606 or 1608, the controller 70 may also perform additional operations in relation to the presence or absence of the agitator 150. For instance, the controller 70 may indicate the current status of the presence or absence of the agitator 150 in the user interface 26. As another possibility, the controller 70 may monitor aspects of the operation of the laundry treating appliance 10, such as to confirm the rotational speed of the basket 30, to determine load size information, such as how high the load is in the basket 30, and/or water level sensing in the basket 30, to identify and/or address an off-balance condition, etc. After operations 1606 or 1608, the process of flowchart 1600 ends.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A system for hardware detection in a laundry treatment appliance, comprising:

a sensor configured to provide data in relation to presence or absence of a removable agitator within the laundry treatment appliance and further to provide data regarding aspects of operation of the laundry treatment appliance;

a memory configured to maintain parameters for one or more cycles of operation of the laundry treatment appliance; and a processor, in communication with the sensor, programmed to:

receive the data from the sensor, identify a type of the removable agitator based on the data from the sensor, identify a configuration of the removable agitator with respect to the laundry treatment appliance based on the data from the sensor, the configuration indicating at least the presence or absence of the removable agitator and, if present, the type of the removable agitator, update settings of the laundry treatment appliance in accordance with the identified configuration of the laundry treatment appliance, including to retrieve, from the memory, parameters for a cycle of operation of the one or more cycles of operation, and alter one or more aspects of the parameters based on the identified configuration, the aspects including one or more of cycle time or agitation speed, perform the cycle of operation using the updated settings, and monitor aspects of the operation of the laundry appliance when performing the cycle using the data from the sensor.

2. The system of claim 1, where the type of the agitator includes one or more of a wobble plate, a hybrid impeller/agitator, or a filtering agitator having an embedded filter.

3. The system of claim 1, wherein the sensor is a reflectance spectroscopy sensor, and the processor is programmed to identify the type of the removable agitator based on color information provided by the sensor, the color information being indicative of a color of light reflected off the removable agitator, and during the operation of the laundry treatment appliance detect which type of agitator is engaged according to the color information, allowing for performance of different behaviors by the laundry treatment appliance based on the type of the agitator.

4. The system of claim 3, wherein the settings are updated to first updated settings responsive to the color information indicating presence of a removable agitator having a surface of a first color, and wherein the settings are updated to second updated settings responsive to the color information indicating presence of a removable agitator having a surface of a second color.

5. The system of claim 1, wherein the parameters of the laundry treatment appliance that are updated include both cycle time and agitation speed.

6. The system of claim 1, wherein the sensor is an inductive sensor, and the processor is further programmed to identify a spin speed of the removable agitator based on the data from the sensor.

7. The system of claim 1, wherein the sensor is an image sensor, and the processor is further programmed to identify a color of articles within the laundry treatment appliance based on the data from the sensor.

8. The system of claim 1, wherein the sensor is an image sensor, the data is image data, and the processor is programmed to determine, using a neural network, the presence or absence and the type, if present, of the removable agitator based on the image data from the image sensor.

9. The system of claim 1, wherein the sensor is an ultrasonic sensor, the data is ping data, and the processor is programmed to determine the presence or absence and the type, if present, of the removable agitator based on a comparison of the ping data to ping times representing the presence or absence of the removable agitator.

10. The system of claim 9, wherein the processor is further programmed to determine one or more of load size, load height, and water level in the laundry treatment appliance based on the ping data.

11. The system of claim 1, wherein the processor is further programmed to indicate the configuration of the removable agitator in a user interface of the laundry treatment appliance.

12. The system of claim 1, wherein to monitor aspects of the operation of the laundry appliance includes to identify an off-balance condition based on data received from the sensor.

13. The system of claim 12, wherein to monitor aspects of the operation of the laundry appliance further includes to address the off-balance condition.

14. The system of claim 1, wherein:

a first type of agitator includes an agitator dispenser for supplying a treating chemistry to the treating chamber, the agitator dispenser being separate from a main treating chemistry dispenser that supplies treating chemistry to the treating chamber, and a second type of agitator does not include the agitator dispenser, and the processor is further programmed to:

update the settings to account for the presence of the agitator dispenser responsive to identification of the type of the removable agitator being of the first type, and update the settings to account for the absence of the agitator dispenser responsive to identification of the type of the removable agitator being of the second type.

15. The system of claim 1, wherein a first type of removable agitator includes embedded filter capabilities, a second type of agitator includes embedded laundry treatment capabilities, and a third type of removable agitator is configured for handling heavily soiled loads.

16. The system of claim 15, wherein:

the settings are updated to account for the embedded filter capabilities responsive to identification of the type of the removable agitator being of the first type, the settings are updated to account for the embedded laundry treatment capabilities responsive to identification of the type of the removable agitator being of the second type, and the settings are updated to account for the handling heavily soiled loads responsive to identification of the type of the removable agitator being of the third type.

* * * * *